US009028040B2

(12) United States Patent
Tamaki et al.

(10) Patent No.: US 9,028,040 B2
(45) **Date of Patent: *May 12, 2015**

(54) LIQUID EJECTION APPARATUS AND LIQUID EJECTION METHOD

(75) Inventors: Shuichi Tamaki, Nagoya (JP); Hiroshi Taira, Ichinomiya (JP); Akira Shinoda, Obu (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/191,003

(22) Filed: Jul. 26, 2011

(65) Prior Publication Data

US 2012/0026219 A1 Feb. 2, 2012

(30) Foreign Application Priority Data

Jul. 30, 2010 (JP) ..... 2010-172235
Jul. 30, 2010 (JP) ..... 2010-172239

(51) Int. Cl.
*B41J 2/165* (2006.01)
*B41J 2/18* (2006.01)
*B41J 2/19* (2006.01)
*B41J 2/20* (2006.01)

(52) U.S. Cl.
CPC ..... *B41J 2/16526* (2013.01); *B41J 2/18* (2013.01); *B41J 2/19* (2013.01); *B41J 2/20* (2013.01)

(58) Field of Classification Search
USPC ..... 347/5, 6, 23, 25, 7, 13, 19
See application file for complete search history.

(56) References Cited

U.S. PATENT DOCUMENTS 4,800,403 A 1/1989 Accattino et al.
6,056,387 A * 5/2000 Kaneko ..... 347/23
6,231,174 B1 5/2001 Haigo (Continued)

FOREIGN PATENT DOCUMENTS

CN 1863677 A 11/2006
CN 101314285 A 12/2008

(Continued)

OTHER PUBLICATIONS

Extended European Search Report dated Oct. 27, 2011 from related European Patent Application 11175406.5.

(Continued)

*Primary Examiner* — Lam Nguyen
(74) *Attorney, Agent, or Firm* — Scully, Scott, Murphy & Presser, P.C.

(57) ABSTRACT

A liquid ejection apparatus including: a liquid ejection head and ejection openings; a tank; an air communication device; a supply channel; a return channel; a supply device; an adjusting device; and a controller, wherein the controller performs a liquid circulation control by controlling: the adjusting device such that a channel resistance value of the return channel is less than a predetermined maximum value; and the supply device to supply the liquid into the inside channel, wherein, when the liquid is circulated by the liquid circulation control, the controller starts a liquid discharge control for discharging the liquid by making the channel resistance value larger than that in the liquid circulation control, and wherein the controller controls the air communication device such that an inside of the tank is interrupted from the ambient air in at least a part of a period of the liquid circulation control.

17 Claims, 18 Drawing Sheets

(56) References Cited

U.S. PATENT DOCUMENTS

| | | | | |
|---|---|---|---|---|
| 7,347,520 | B2 | 3/2008 | Ito | |
| 7,874,656 | B2 | 1/2011 | Ota et al. | |
| 8,038,267 | B2 | 10/2011 | Kinase et al. | |
| 2002/0060713 | A1 | 5/2002 | Katakura et al. | |
| 2005/0212874 | A1 | 9/2005 | Nomura et al. | |
| 2006/0007254 | A1 * | 1/2006 | Tanno et al. | 347/7 |
| 2006/0103700 | A1 | 5/2006 | Taira | |
| 2006/0132554 | A1 | 6/2006 | Ota et al. | |
| 2006/0176330 | A1 | 8/2006 | Ito | |
| 2007/0120912 | A1 | 5/2007 | Lim et al. | |
| 2007/0211106 | A1 | 9/2007 | Eguchi et al. | |
| 2008/0239027 | A1 | 10/2008 | Kinase et al. | |
| 2008/0273064 | A1 | 11/2008 | Ota et al. | |
| 2008/0297546 | A1 | 12/2008 | Lee et al. | |
| 2009/0002467 | A1 | 1/2009 | Watanabe | |
| 2009/0289976 | A1 | 11/2009 | Nishimura | |
| 2010/0321424 | A1 | 12/2010 | Tamaki | |

FOREIGN PATENT DOCUMENTS

| | | | |
|---|---|---|---|
| CN | 101332714 | A | 12/2008 |
| EP | 0884185 | A2 | 12/1998 |
| EP | 0 903 235 | A2 | 3/1999 |
| EP | 0 916 502 | A2 | 5/1999 |
| EP | 1 790 482 | A2 | 5/2007 |
| JP | S63107561 | A | 5/1988 |
| JP | H11078067 | A | 3/1999 |
| JP | H11-268302 | A | 10/1999 |
| JP | H11-300988 | A | 11/1999 |
| JP | 2000-025245 | A | 1/2000 |
| JP | 2002361908 | A | 12/2002 |
| JP | 2004-230906 | A | 8/2004 |
| JP | 2005-306005 | | 11/2005 |
| JP | 2006-168339 | A | 6/2006 |
| JP | A-2006-159811 | | 6/2006 |
| JP | A-2006-213021 | | 8/2006 |
| JP | 2006-315200 | A | 11/2006 |
| JP | A-2008-55646 | | 3/2008 |
| JP | A-2008-264767 | | 11/2008 |
| JP | A-2009-006729 | | 1/2009 |
| JP | 2009-29111 | | 2/2009 |
| JP | 2009-279816 | | 12/2009 |
| JP | 2010162728 | A | 7/2010 |
| JP | 2011-834 | | 1/2011 |
| WO | WO 2006/064040 | A1 | 6/2006 |

OTHER PUBLICATIONS

Notification of Reason for Refusal dated Nov. 27, 2012 received from the Japanese Patent Office from related Japanese Application No. 2010-172237 and U.S. Appl. No. 13/191,024, together with an English-language translation.

Extended European Search Report dated Oct. 27, 2011 from related European Patent Application 11175388.5 and U.S. Appl. No. 13/191,024.

Notification of Reason for Refusal dated Nov. 27, 2012 received from the Japanese Patent Office from related Japanese Application No. 2010-172235, together with an English-language translation.

US Official Action dated Apr. 16, 2013 received in related U.S. Appl. No. 13/191,024.

U.S. Office Action dated Nov. 25, 2013 from related U.S. Appl. No. 13/191,024.

Notification of Reason for Refusal dated Sep. 3, 2013 received from the Japanese Patent Office from counterpart Japanese Application No. 2010-172239 together with English translation.

Notification of First Office Action dated Sep. 2, 2013 received from the Chinese Patent Office from counterpart Chinese Application No. 201110214611.2 together with English translation.

Japanese Office Action dated May 27, 2014 in counterpart Japanese Patent Application No. 2010-172239.

U.S. Office Action dated Jul. 17, 2014 from related U.S. Appl. No. 13/191,024.

Notification of Second Office Action dated Jul. 8, 2014 received from the Chinese Patent Office from counterpart Chinese Application No. 201110214611.2 together with an English language translation.

Notification of Reason for Refusal dated Aug. 6, 2013 received from the Japanese Patent Office from counterpart Japanese Application No. 2010-172237 together with English translation from related U.S. Appl. No. 13/191,024.

Notification of First Office Action dated Aug. 27, 2013 received from the Chinese Patent Office from counterpart Chinese Application No. 201110214614.6 together with English translation from related U.S. Appl. No. 13/191,024.

European Office Action dated Oct. 7, 2014 from counterpart Application No. EP 11 175 388.5 of related U.S. Appl. No. 13/191,024.

European Office Action dated Oct. 7, 2014 from counterpart Application No. EP 11 175 406.5.

Notice of Allowance dated Dec. 5, 2014 from related U.S. Appl. No. 13/191,024.

* cited by examiner

LIQUID EJECTION APPARATUS AND LIQUID EJECTION METHOD

CROSS REFERENCE TO RELATED APPLICATION

The present application claims priority from Japanese Patent Application Nos. 2010-172235 filed on Jul. 30, 2010, and 2010-172239 filed on Jul. 30, 2010, the disclosures of which are herein incorporated by reference in its entirety.

BACKGROUND OF THE INVENTION

1. Field of the Invention

The present invention relates to a liquid ejection apparatus configured to eject liquid from ejection openings and a liquid ejection method of the liquid ejection apparatus.

2. Description of the Related Art

There is known an ink-jet head configured to eject ink droplets from a plurality of ejection openings and perform a cleaning for the ejection openings by forcibly supplying the ink into ink channels in the ink-jet head by a pump and to discharge air bubbles and thickened viscous ink remaining in portions of the ink channels which are located near the ejection openings. For example, after a three-way valve is closed to close and seal a discharging passage, a supply pump is operated to pressurize the ink in the ink channels for a predetermined length of time, thereby discharging the ink from nozzles to perform the cleaning of the nozzles.

SUMMARY OF THE INVENTION

In order to perform a cleaning of ejection openings by reliably discharging ink from all the ejection openings, an ink pressure applied to ink channels needs to be increased to a desired pressure. However, if a relatively long time is required for the ink pressure in the ink channels to reach the desired pressure after the pump starts to be driven, the ink is discharged from the ejection openings in the order of their ink-discharge resistances or channel resistances, an ejection opening having the lowest ink-discharge resistance first. This makes it impossible to instantaneously discharge the ink from all the ejection openings at the same time. Thus, the ink is needlessly discharged from the ejection openings in the cleaning of the ejection openings.

This invention has been developed in view of the above-described situations, and it is an object of the present invention to provide a liquid ejection apparatus configured to efficiently discharge air bubbles and foreign matters from all ejection openings together with liquid while preventing unnecessary consumption of the liquid, and a liquid ejection method of the liquid ejection apparatus.

The object indicated above may be achieved according to the present invention which provides a liquid ejection apparatus comprising: a liquid ejection head including: an inlet opening into which liquid flows; an outlet opening from which the liquid having flowed into the inlet opening flows; an inside channel communicating the inlet opening and the outlet opening with each other; and a plurality of ejection openings through which is ejected the liquid having flowed through a plurality of individual channels that are branched from the inside channel; a tank storing the liquid to be supplied to the liquid ejection head; an air communication device configured to communicate an inside of the tank with an ambient air or interrupt the communication of the inside of the tank with the ambient air; a supply channel communicating the inside of the tank and the inlet opening with each other; a return channel communicating the inside of the tank and the outlet opening with each other; a supply device configured to supply the liquid in the tank to the inside channel via the supply channel; an adjusting device configured to adjust a channel resistance value of the return channel between a predetermined minimum value and a predetermined maximum value; and a controller configured to control the air communication device, the supply device, and the adjusting device, wherein the controller is configured to perform a liquid circulation control for circulating the liquid through the supply channel, the inside channel, and the return channel in order by controlling (i) the adjusting device such that the channel resistance value is less than the predetermined maximum value and (ii) the supply device to supply the liquid into the inside channel, wherein, when the liquid is circulated by the liquid circulation control, the controller starts a liquid discharge control for discharging the liquid from the plurality of the ejection openings by increasing the channel resistance value to a value larger than the channel resistance value in the liquid circulation control, and wherein the controller controls the air communication device such that the inside of the tank is interrupted from the ambient air in at least a part of a period of the liquid circulation control.

The object indicated above may also be achieved according to the present invention which provides a liquid ejection apparatus comprising: a liquid ejection head including: an inlet opening into which liquid flows; an outlet opening from which the liquid having flowed into the inlet opening flows; an inside channel communicating the inlet opening and the outlet opening with each other; and a plurality of ejection openings through which is ejected the liquid having flowed through a plurality of individual channels that are branched from the inside channel; a tank storing the liquid to be supplied to the liquid ejection head; an air communication device configured to communicate an inside of the tank with an ambient air or interrupt the communication of the inside of the tank with the ambient air; a supply channel communicating the inside of the tank and the inlet opening with each other; a return channel communicating the inside of the tank and the outlet opening with each other; a supply device configured to supply the liquid in the tank to the inside channel via the supply channel; an adjusting device provided at a predetermined area expanding from the outlet opening of the inside channel, and configured to adjust a channel resistance value of the liquid in the inside channel between a predetermined minimum value and a predetermined maximum value; and a controller configured to control the air communication device, the supply device, and the adjusting device, wherein the controller is configured to perform a liquid circulation control for circulating the liquid through the supply channel, the inside channel, and the return channel in order by controlling (i) the adjusting device such that the channel resistance value is less than the predetermined maximum value and (ii) the supply device to supply the liquid into the inside channel, wherein, when the liquid is circulated by the liquid circulation control, the controller starts a liquid discharge control for discharging the liquid from the plurality of the ejection openings by increasing the channel resistance value to a value larger than the channel resistance value in the liquid circulation control, and wherein the controller controls the air communication device such that the inside of the tank is interrupted from the ambient air in at least a part of a period of the liquid circulation control.

The object indicated above may also be achieved according to the present invention which provides a liquid ejection method of a liquid ejection apparatus comprising: a liquid ejection head including: an inlet opening into which liquid flows; an outlet opening from which the liquid having flowed into the inlet opening flows; an inside channel communicating the inlet opening and the outlet opening with each other; and a plurality of ejection openings through which is ejected the liquid having flowed through a plurality of individual channels that are branched from the inside channel; a tank storing the liquid to be supplied to the liquid ejection head; an air communication device configured to communicate an inside of the tank with an ambient air or interrupt the communication of the inside of the tank with the ambient air; a supply channel communicating the inside of the tank and the inlet opening with each other; a return channel communicating the inside of the tank and the outlet opening with each other; a supply device configured to supply the liquid in the tank to the inside channel via the supply channel; and an adjusting device configured to adjust a channel resistance value of the return channel between a predetermined minimum value and a predetermined maximum value, the liquid ejection method comprising: performing a liquid circulation control for circulating the liquid through the supply channel, the inside channel, and the return channel in order by controlling (i) the adjusting device such that the channel resistance value is less than the predetermined maximum value and (ii) the supply device to supply the liquid into the inside channel; starting, when the liquid is circulated by the liquid circulation control, a liquid discharge control for discharging the liquid from the plurality of the ejection openings by increasing the channel resistance value to a value larger than the channel resistance value in the liquid circulation control; and controlling the air communication device such that the inside of the tank is interrupted from the ambient air in at least a part of a period of the liquid circulation control.

In the liquid ejection apparatuses and method described above, performing the liquid circulation increases an internal pressure of the inside channel. In this circulation, the channel resistance value is increased by the adjustment of the adjusting device, thereby momentarily raising the internal pressure of the inside channel. As a result, the liquid in the inside channel flows into the individual channels and is discharged from the ejection openings. In this operation, a relatively high pressure is applied to all the ejection openings from the start of the discharge. Accordingly, it is possible to efficiently discharge thickened liquid in the ejection openings, air bubbles, and foreign matters, and it is possible to prevent the liquid from being discharged needlessly. Further, the tank and the ambient air are interrupted from each other in the circulation, thereby producing a negative pressure in the tank. Thus, the liquid in the inside channel is sucked into the tank via the return channel, making it more difficult for the liquid in the inside channel to flow into the individual channels. As a result, the liquid is less likely to leak from the ejection openings during the circulation, thereby further preventing the liquid from being discharged needlessly.

BRIEF DESCRIPTION OF THE DRAWINGS

The objects, features, advantages, and technical and industrial significance of the present invention will be better understood by reading the following detailed description of embodiments of the invention, when considered in connection with the accompanying drawings, in which.

DETAILED DESCRIPTION OF THE EMBODIMENTS

Hereinafter, there will be described embodiments of the present invention by reference to the drawings.

First Embodiment

Figure 1:
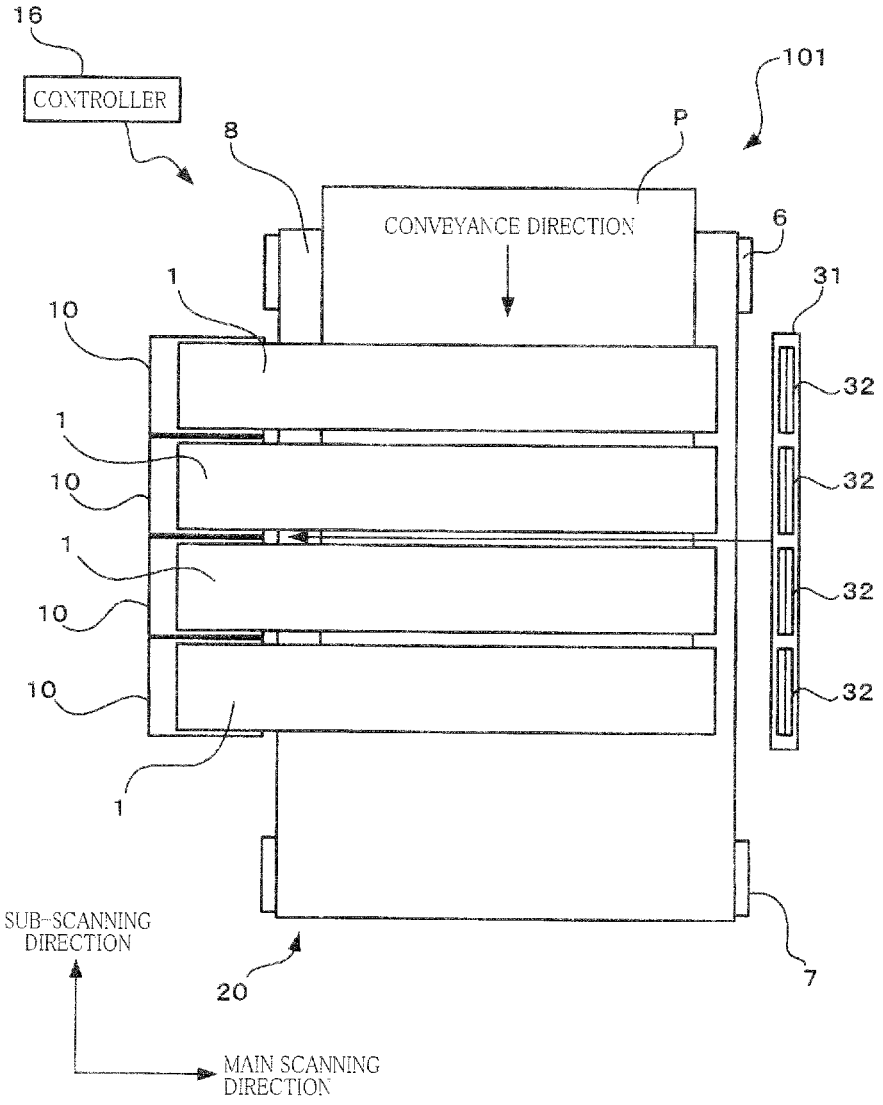
FIG. 1 is a plan view generally showing an ink-jet printer as a first embodiment of the present invention.

As shown in FIG. 1, an ink-jet printer 101 as one example of a liquid ejection apparatus includes: (a) a sheet conveyance unit 20 configured to convey a sheet P from an upper side toward a lower side in FIG. 1; (b) four ink-jet heads 1 (each as one example of liquid ejection head) configured to eject droplets of inks of respective four colors, namely, black, magenta, cyan, and yellow onto the sheet P conveyed by the conveyance unit 20; four ink supply units 10 configured to respectively supply the inks to the ink-jet heads 1; a maintenance unit 31 configured to perform a maintenance for ink-jet heads 1; and a controller 16 configured to control entire operations of the ink-jet printer 101. It is noted that, in the present embodiment, a sub-scanning direction is a direction parallel to a conveyance direction in which the conveyance unit 20 conveys the sheet P, and a main scanning direction is a direction perpendicular to the sub-scanning direction and along a horizontal plane.

The conveyance unit 20 includes two belt rollers 6, 7 and an endless sheet conveyance belt 8 wound around the rollers 6, 7. The belt roller 7 is a drive roller that is rotated by a drive power from a conveyance motor, not shown. The belt roller 6 is a driven roller that is rotated in accordance with the running or rotation of the conveyance belt 8 which is caused by the rotation of the belt roller 7. The sheet P placed on an outer circumferential face of the conveyance belt 8 is conveyed toward the lower side in FIG. 1.

The four ink-jet heads 1 each extends in the main scanning direction and are disposed in parallel with one another in the sub-scanning direction. That is, the ink-jet printer 101 is a line-type color ink-jet printer in which a plurality of ejection openings (nozzles) 108 through which the ink droplets are ejected are arranged in the main scanning direction. A lower face of each ink-jet head 1 functions as an ejection face 2*a* in which the plurality of the ejection openings 108 are formed (see FIGS. 2-4).

An outer circumferential face of an upper portion of the conveyance belt 8 and the ejection faces 2*a* face and parallel with each other. When the sheet P conveyed on the conveyance belt 8 passes through positions just under the four ink-jet heads 1, the ink droplets of four colors are ejected in order from the respective ink-jet heads 1 onto an upper face of the sheet P, whereby a desired color image is formed on the sheet P.

Each of the ink supply units 10 is connected to a left end portion of the lower face of a corresponding one of the ink-jet heads 1 in FIG. 1 so as to supply the ink to the corresponding ink-jet head 1.

The maintenance unit 31 includes four wiper members 32. Each of the wiper members 32 is an elastic member for wiping the ejection face 2*a* of a corresponding one of the ink-jet heads 1 in a wiping operation of a maintenance operation which will be described below. Each wiper member 32 is reciprocable by an actuator, not shown, in the main scanning direction (indicated by an arrow in FIG. 1).

Figure 2:
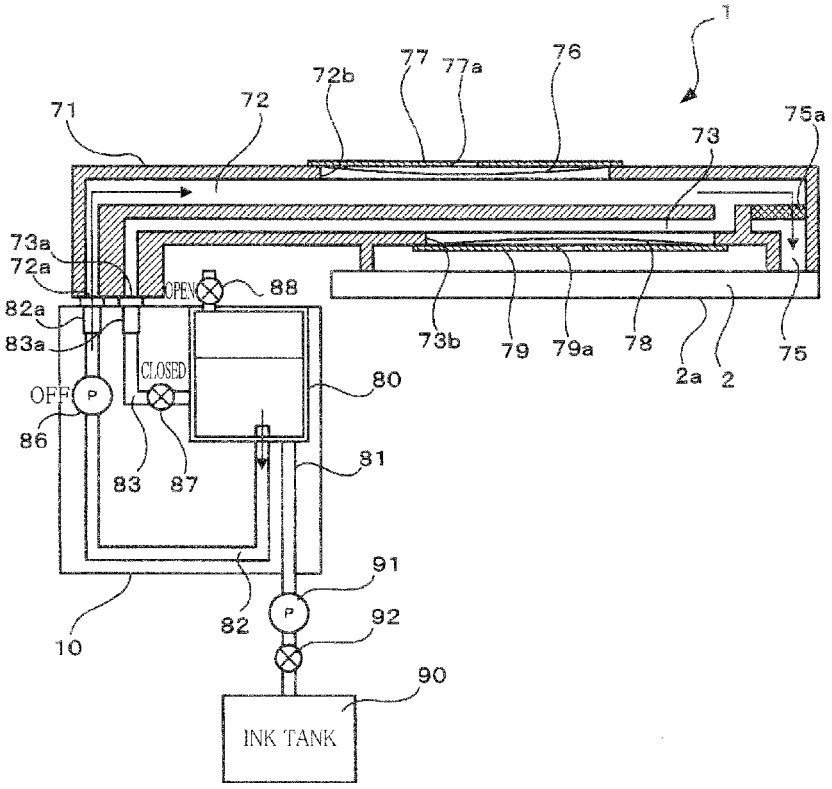
FIG. 2 is a cross-sectional view showing an ink-jet head and an ink supply unit shown in FIG. 1.

There will be next explained the ink-jet heads 1 in detail with reference to FIG. 2. As shown in FIG. 2, each ink-jet head 1 includes a reservoir unit 71 and a head main body 2.

The reservoir unit 71 is a channel defining member that is fixed to an upper face of the head main body 2 and supplies the ink to the head main body 2. The reservoir unit 71 has an ink inlet channel 72 (as one example of an inside channel), ten ink outlet channels 75, and a discharge channel 73 (as another example of an inside channel) formed therein. It is noted that only a single ink outlet channel 75 is shown in FIG. 2.

The ink inlet channel 72 is a channel into which the ink from the ink supply unit 10 flows via an inlet opening 72*a* opened in a lower face of the reservoir unit 71. The ink inlet channel 72 functions as an ink reservoir for temporarily storing the flowed ink. In an inner wall face of the ink inlet channel 72, there is formed a hole 72*b* formed through an outer wall face of the reservoir unit 71. A flexible resin film 76 seals the hole 72*b* from a side of the hole 72*b* which is nearer to the outer wall face of the ink inlet channel 72. That is, the hole 72*b* is sealed by the resin film 76 from a side of the hole 72*b* which is nearer to the outer wall face of the reservoir unit 71. That is, the resin film 76 partly constitutes the inner wall face of the ink inlet channel 72. In other words, at least a part of the inner wall face of the ink inlet channel 72 is formed of a flexible material. The resin film 76 is displaced according to changes of a pressure of the ink in the ink inlet channel 72, functioning as a damper for restraining the changes of the ink pressure. Using the resin film 76 enables to provide the damper at low cost. It is noted that, in a normal recording, the resin film 76 slightly projects toward an inside of the ink inlet channel 72. To the outer wall face of the reservoir unit 71 is fixed a plate-like restraining member 77 so as to cover the hole 72*b*, thereby restraining the resin film 76 from projecting toward an outside of the reservoir unit 71. As a result, it is possible to prevent the resin film 76 from being broken by being excessively displaced when the ink pressure in the ink inlet channel 72 becomes excessively high. In the restraining member 77 is formed an air communicating hole 77*a* that always keeps a pressure between the restraining member 77 and the resin film 76 at an atmospheric pressure. This facilitates the displacement of the resin film 76.

Figure 3:
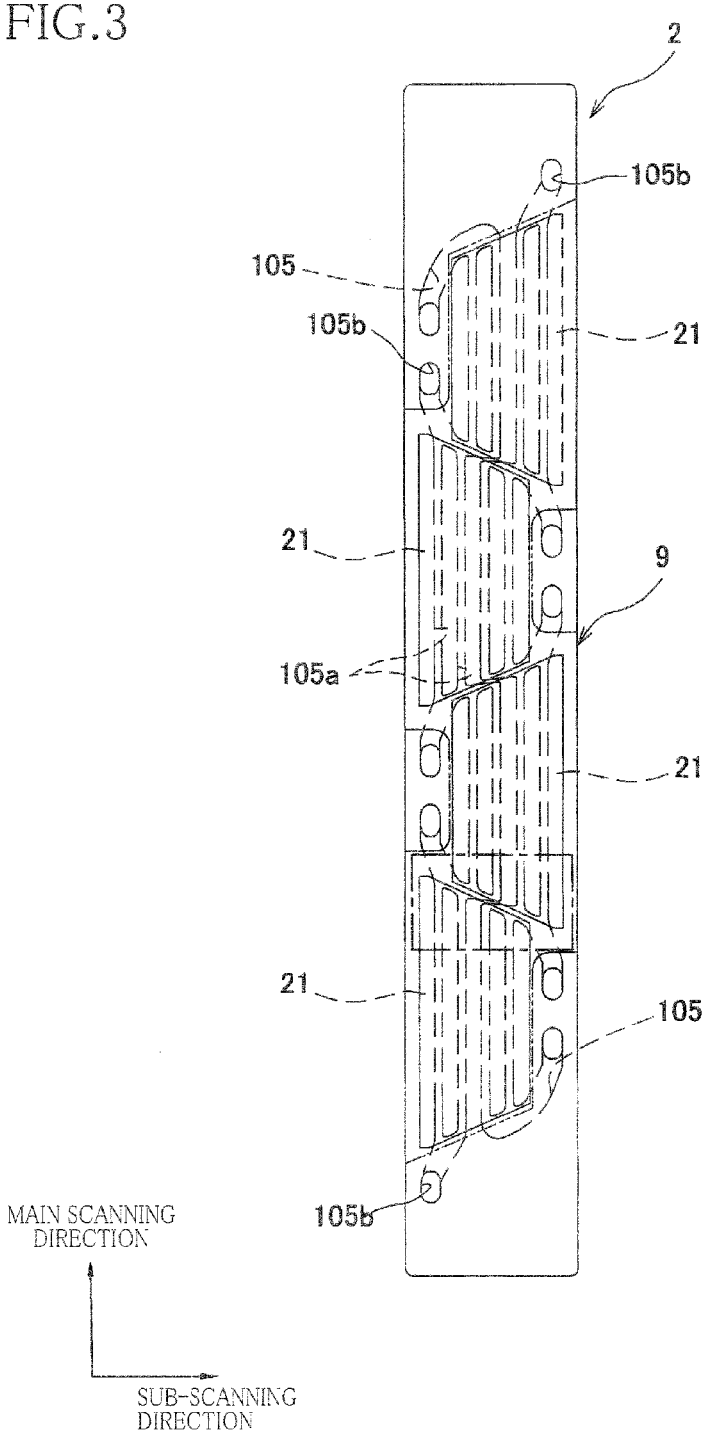
FIG. 3 is a plan view showing a head main body shown in FIG. 2.

The ink outlet channels 75 communicate with the ink inlet channel 72 via a filter 75*a* and with ink supply openings 105*b* formed in an upper face of a channel unit 9 (see FIG. 3). The filter 75*a* extends in a direction in which the ink flows in the ink inlet channel 72 (i.e., in the rightward and leftward direction in FIG. 2). In the normal recording, the ink supplied from the ink supply unit 10 flows into the ink inlet channel 72, then passes through the ink outlet channels 75, and finally is supplied from the ink supply openings 105*b* to the channel unit 9.

The discharge channel 73 communicates with the ink inlet channel 72 at a portion thereof located on an upstream side of the filter 75*a* and is connected to the ink supply unit 10 via an outlet opening 73*a* formed in the lower face of the reservoir unit 71.

In a lower inner wall face of the discharge channel 73, there is formed a hole 73*b* formed through the outer wall face of the reservoir unit 71. The hole 73*b* is sealed by a flexible resin film 78 from a lower side of the hole 73*b*, i.e., from a side of the hole 73*b* which is nearer to the outer wall face of the reservoir unit 71. That is, the resin film 78 partly constitutes the inner wall face of the discharge channel 73. In other words, at least a part of the inner wall face of the discharge channel 73 is formed of a flexible material. The resin film 78 is displaced according to changes of a pressure of the ink in the discharge channel 73, functioning as a damper for restraining the changes of the ink pressure. Using the resin film 78 enables to provide the damper at low cost. It is noted that, in the normal recording, the resin film 78 slightly projects toward an inside of the discharge channel 73. To the lower outer wall face of the reservoir unit 71 is fixed a plate-like restraining member 79 so as to cover the hole 73*b*, thereby restraining the resin film 78 from projecting toward an outside of the reservoir unit 71. As a result, it is possible to prevent the resin film 78 from being broken by being excessively displaced when the ink pressure in the discharge channel 73 becomes excessively high. In the restraining member 79 is formed an air communicating hole 79*a* that always keeps a pressure between the restraining member 79 and the resin film 78 at the atmospheric pressure. This facilitates the displacement of the resin film 78. In ink circulation which will be described below, the ink supplied from the ink supply unit 10 flows into the ink inlet channel 72 via the inlet opening 72*a*, then passes from the ink inlet channel 72 through the discharge channel 73, and finally returns to the ink supply unit 10 via the outlet opening 73*a* (see FIG. 10).

Figure 4:
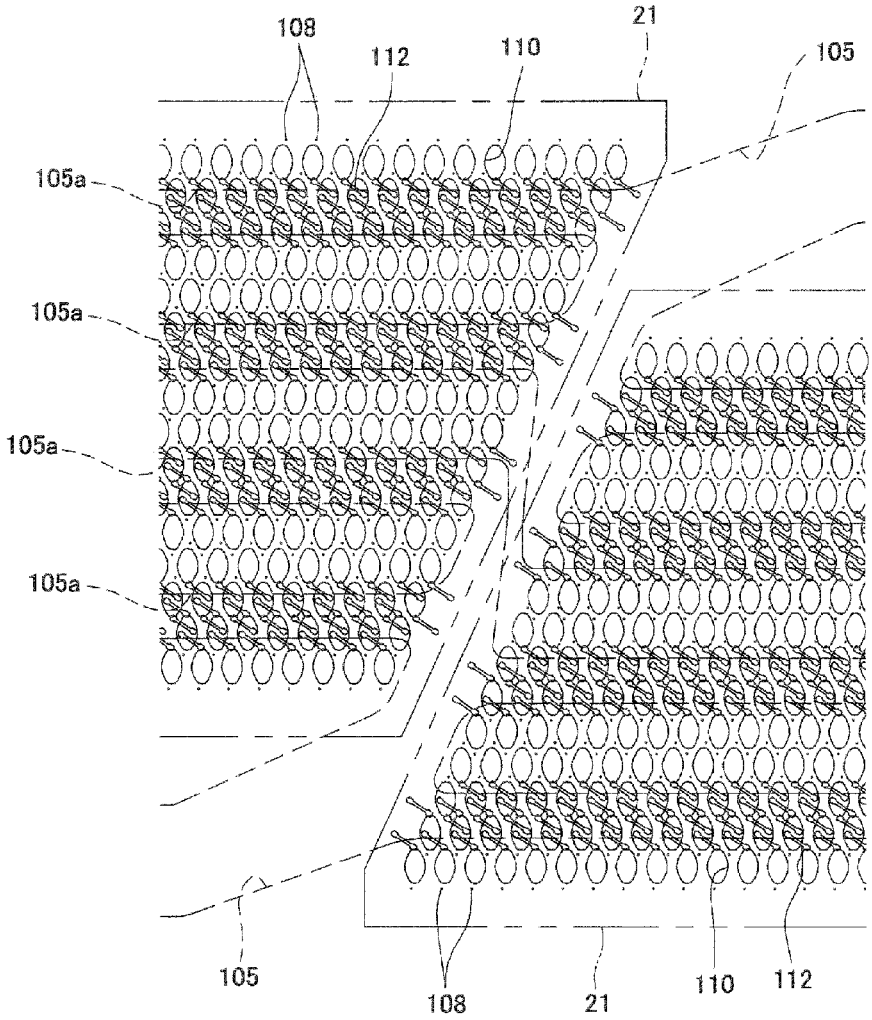
FIG. 4 is an enlarged view showing an area enclosed by a one-dot chain line shown in FIG. 3.
Figure 5:
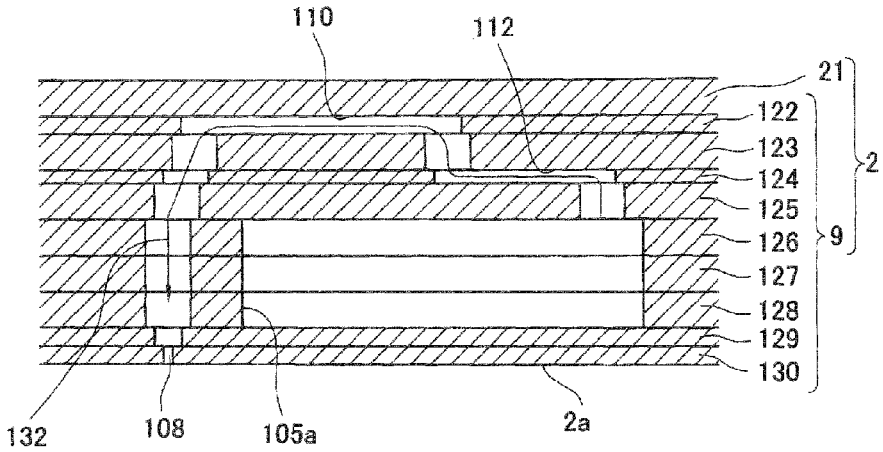
FIG. 5 is a partial cross-sectional view showing the ink-jet head shown in FIG. 4.

There will be next explained the head main body 2 in more detail with reference to FIGS. 3-5. It is noted that, in FIG. 4, pressure chambers 110, apertures 112, and the ejection openings 108 are illustrated by solid lines for easier understanding purposes though these elements should be illustrated by broken lines because these elements are located under actuator units 21.

As shown in FIGS. 3-5, the head main body 2 includes the channel unit 9 and the four actuator units 21 (each as a pressure-vibration applying device) fixed to the upper face of the channel unit 9. The channel unit 9 has ink channels including the pressure chambers 110 and so on. The actuator units 21 include a plurality of unimorph actuators respectively corresponding to the pressure chambers 110 so as to selectively apply ejection energy to the ink in the pressure chambers 110.

As shown in FIG. 5, the channel unit 9 is a stacked body constituted by a plurality of metal plates 122-130 formed of stainless steel and positioned and stacked on each other. In the channel unit 9, there are formed channels extending from a plurality of manifold channels 105 to the ejection openings 108 via the pressure chambers 110. As shown in FIG. 3, the upper face of the channel unit 9 has the ten ink supply openings 105*b* opened therein which communicate respectively with the ink outlet channels 75 of the reservoir unit 71 (see FIG. 2). As shown in FIG. 4, in the channel unit 9 are formed the manifold channels 105 and a plurality of sub-manifold channels 105*a*. Each of the ink supply openings 105*b* communicates with a corresponding one of the manifold channels 105, and each of the sub-manifold channels 105*a* is included in a corresponding one of the manifold channels 105. Further, as shown in FIG. 5, in the channel unit 9 is formed a plurality of individual ink channels 132 each branched from a corresponding one of the sub-manifold channels 105*a* and extending to a corresponding one of the ejection openings 108 opened in the ejection face 2*a* via a corresponding one of the pressure chambers 110. In the ejection face 2*a*, the ejection openings 108 are formed in matrix.

There will be next explained flow of the ink in the channel unit 9. As shown in FIGS. 3-5, in the normal recording, the ink supplied from the ink outlet channels 75 of the reservoir unit 71 to the ink supply openings 105*b* is distributed to the sub-manifold channels 105*a* of the manifold channels 105. The ink in the sub-manifold channels 105*a* flows into the individual ink channels 132 via the respective apertures 112 and the respective pressure chambers 110 and reaches the ejection openings 108 via the respective pressure chambers 110.

Figure 6:
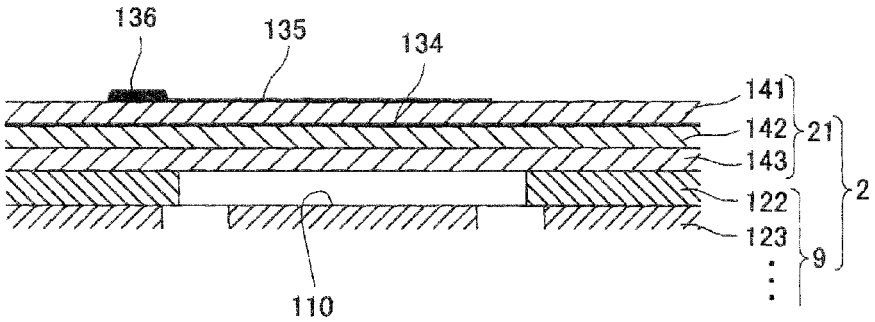
FIG. 6 is an enlarged view partially showing an actuator unit shown in FIG. 5.

There will be next explained the actuator units 21. As shown in FIG. 6, each of the actuator units 21 is a piezoelectric actuator constituted by three piezoelectric sheets 141-143 each formed of a ceramic material of lead zirconate titanate (PZT) having ferroelectricity. The uppermost piezoelectric sheet 141 is polarized in a thickness direction thereof. Further, a plurality of individual electrodes 135 are provided on an upper face of the piezoelectric sheet 141. Between the piezoelectric sheet 141 and the piezoelectric sheet 142 disposed under the sheet 141, there is provided a common electrode 134 expanding over the piezoelectric sheets. The piezoelectric sheet 141 is interposed between the plurality of the individual electrodes 135 and the common electrode 134.

The individual electrodes 135 respectively face the pressure chambers 110. On a distal end of each of the individual electrodes 135, there is provided a corresponding one of individual lands 136 that is electrically connected to the individual electrode 135. When an electric field is applied to the piezoelectric sheet 141 in the polarization direction thereof in a state in which the individual electrodes 135 are given a potential different from that of the common electrode 134, portions of the piezoelectric sheet 141 to which the electric field has been applied function as active portions that are deformed due to a piezoelectric effect. As a result, portions interposed between the respective individual electrodes 135 and the respective pressure chambers 110 function as individual actuators. That is, each actuator unit 21 is a piezoelectric element including a plurality of the actuators respectively corresponding to the pressure chambers 110.

A ground potential is uniformly applied to areas of the common electrode 134 which respectively correspond to all the pressure chambers 110. On the other hand, drive signals are supplied to the individual electrodes 135.

Here, there will be explained a method of driving the actuator units 21. For example, where the polarization direction coincides with a direction in which the electric field is applied, the active portions contract in a direction perpendicular to the polarization direction (i.e., in a planar direction). Here, each actuator unit 21 is what is called a unimorph actuator in which the upper piezoelectric sheet 141 distant from the pressure chambers 110 includes the active portions, and the lower piezoelectric sheets 142, 143 nearer to the pressure chambers 110 function as non-active layers. The piezoelectric sheets 141-143 are fixed to an upper face of the plate 122 for defining the pressure chambers 110. Thus, when the active portion (electric-field applied portion) has contracted in the planar direction, and the piezoelectric sheets 142, 143 under the sheet 141 have been deformed by different amounts from each other in the planar direction, an entirety of the piezoelectric sheets 141-143 is deformed so as to project toward the pressure chamber 110 (a unimorph deformation). As a result, a pressure (ejection energy) is applied to the ink in the pressure chamber 110, whereby the ink droplet is ejected from the nozzle 108.

Figure 9A:
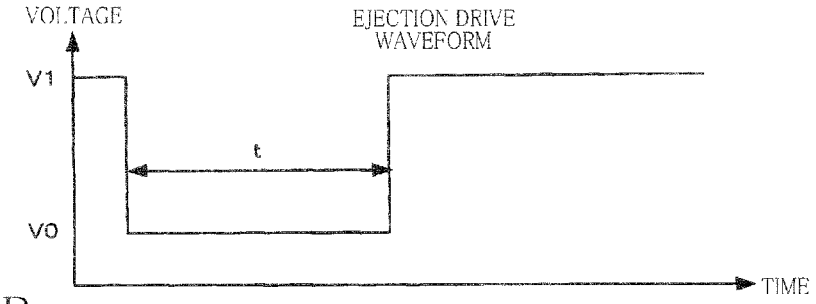
FIG. 9A is a waveform chart of an ejection driving signal produced by a head controller shown in FIG. 8.

It is noted that, as shown in FIG. 9A, in the present embodiment, a drive signal is supplied such that a predetermined electric potential is applied in advance to each individual electrode 135, and then after the individual electrode 135 is temporarily made at a ground potential in each ejection requirement, the predetermined electric potential is applied again to the individual electrode 135 at a predetermined timing. In this case, the piezoelectric sheets 141-143 return to their original states at the timing when the individual electrode 135 becomes at the ground potential. Thus, a volume of the corresponding pressure chamber 110 is increased when compared with its initial state (i.e., the state in which the voltage is applied in advance), whereby the ink is sucked from the sub-manifold channel 105*a* into the individual ink channel 132. Then, the portion of the piezoelectric sheets 141-143 which faces the corresponding active portion is deformed so as to project toward the pressure chamber 110 at the timing when the predetermined electric potential is applied again to the individual electrode 135. As a result, the volume of the pressure chamber 110 is decreased, which increases a pressure exerted on the ink, whereby the ink droplet is ejected from the nozzle 108.

There will be next explained the ink supply unit 10 in detail. As shown in FIG. 2, each ink supply unit 10 includes: (a) a sub-tank 80; (b) an ink replenish tube 81 connected to the sub-tank 80; (c) a replenish pump 91 and a replenish valve 92 provided on the ink replenish tube 81; (d) an ink supply tube 82 and an ink returning tube 83; (e) a purging pump 86 provided on the ink supply tube 82; (f) a circulation valve 87 as one example of an adjusting device provided on the ink returning tube 83; and (g) an air communicating valve 88 as one example of an air communication device connected to the sub-tank 80.

The sub-tank 80 is for storing the ink to be supplied to the ink-jet head 1. When an amount of the ink in the sub-tank 80 becomes small, the replenish valve 92 is opened and the replenish pump 91 is driven, thereby replenishing the ink stored in an ink tank 90 to the sub-tank 80 via the ink replenish tube 81. The air communicating valve 88 communicates, in its open state, an inside of the sub-tank 80 with an ambient air or interrupts, in its closed state, the communication of the sub-tank 80 with the ambient air. In the normal recording, the air communicating valve 88 is open, so that the inside of the sub-tank 80 and the ambient air communicate with each other. As a result, an air pressure in the sub-tank 80 is always kept at an atmospheric pressure regardless of the amount of the ink stored in the sub-tank 80, ensuring stable ink supply.

Figure 7:
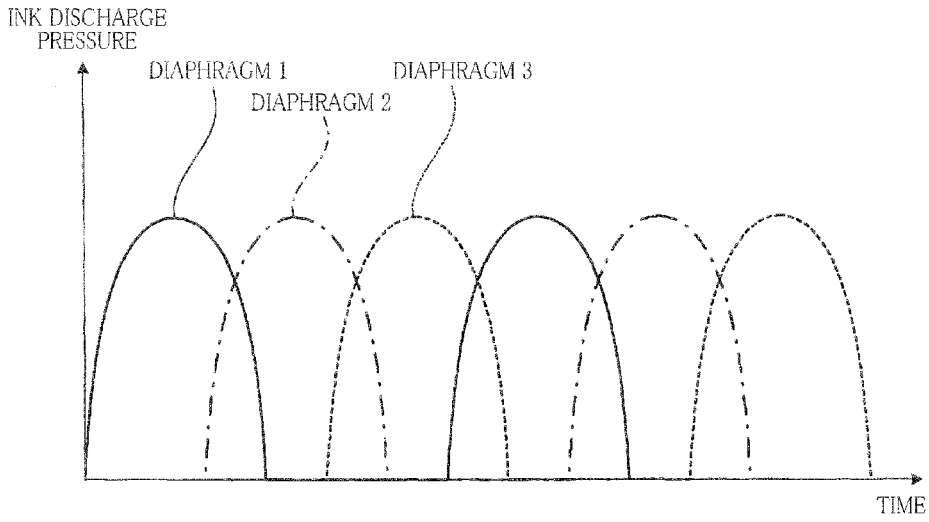
FIG. 7 is a graph showing operational characteristics of a purging pump shown in FIG. 2.

One end of the ink supply tube 82 is connected to the sub-tank 80, and the other end thereof is connected to the inlet opening 72*a* of the reservoir unit 71 via a joint 82*a*. Thus, the ink in the sub-tank 80 is supplied to the ink inlet channel 72 of the reservoir unit 71 via the ink supply tube 82. The purging pump 86 functions as a supply portion which is driven to forcibly supply the ink in the sub-tank 80 to the ink inlet channel 72 via the ink supply tube 82. Further, the purging pump 86 functions as a check valve which prevents the ink from flowing from the joint 82*a* toward the sub-tank 80 in the ink supply tube 82. It is noted that, even where the purging pump 86 is stopped, the ink in the sub-tank 80 can be supplied to the reservoir unit 71 by flowing through the ink supply tube 82. The purging pump 86 is a three-phase diaphragm pump as a volume pump, and as shown in FIG. 7, three diaphragms are driven in different phases to discharge the ink, thereby restraining a pressure variation upon the ink supply.

As shown in FIG. 2, one end of the ink returning tube 83 is connected to the sub-tank 80, and the other end thereof is connected to the outlet opening 73*a* of the reservoir unit 71 via a joint 83*a*. The circulation valve 87 is an adjustment portion configured to adjust a channel resistance value of the ink returning tube 83 between a predetermined minimum value (in an open state of the circulation valve 87) and a predetermined maximum value (in a closed state of the circulation valve 87). It is noted that, in the present embodiment, the circulation valve 87 is an open-and-close valve for changing between (a) its open state in which the flow of the ink is not interrupted at all and (b) its closed state in which the flow of the ink is completely interrupted or inhibited, but the circulation valve 87 may be a channel controlling valve capable of adjusting the channel resistance value at any value.

Figure 8:
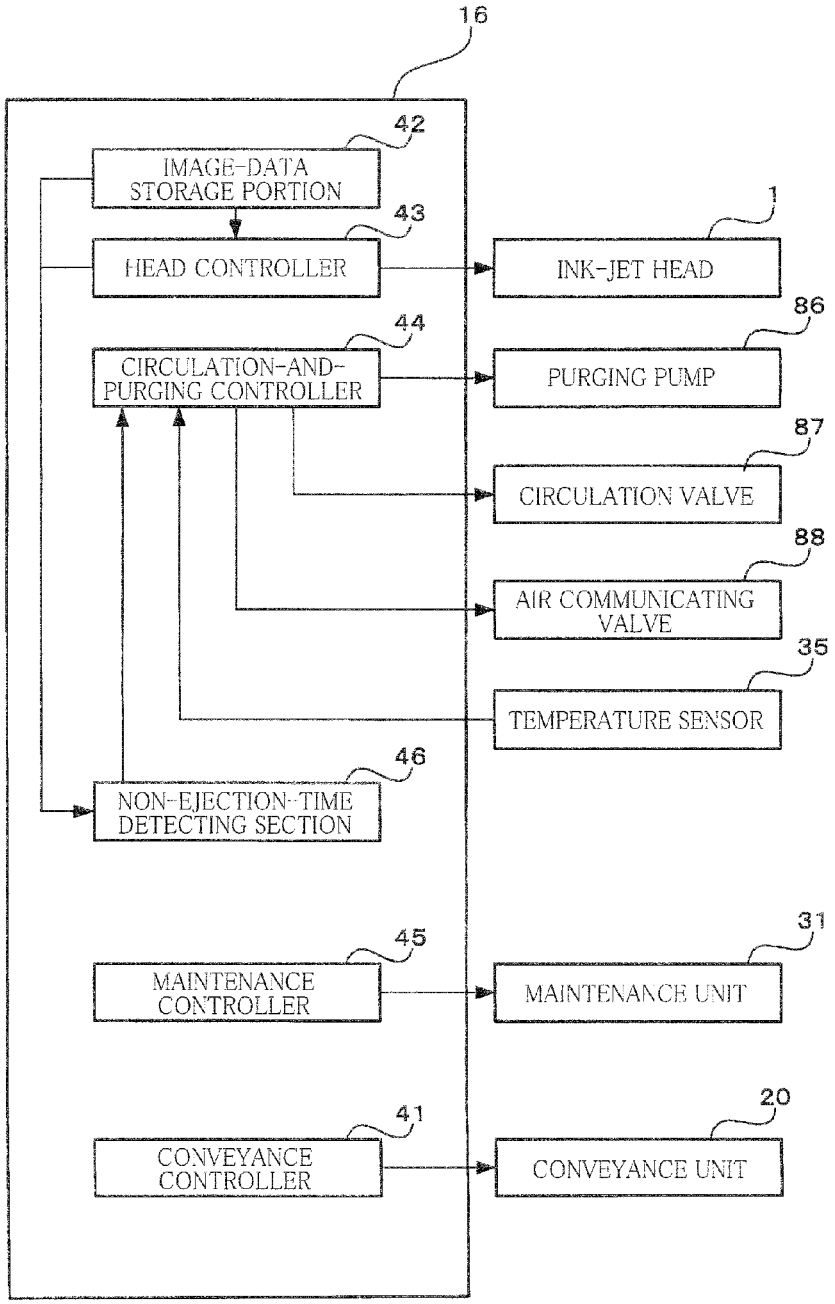
FIG. 8 is a functional block diagram of a controller shown in FIG. 1.

There will be next explained the controller 16 with reference to FIG. 8. The controller 16 includes: a Central Processing Unit (CPU); an Electrically Erasable and Programmable Read Only Memory (EEPROM) that rewritably stores programs to be executed by the CPU and data used for the programs; and a Random Access Memory (RAM) that temporarily stores data when the program is executed. The controller 16 includes various functioning sections which are constituted by cooperation of these hardwares and softwares in the EEPROM with each other. The controller 16 is configured to control entire operations of the ink-jet printer 101 and includes: a conveyance controller 41; an image-data storage portion 42; a head controller 43; a non-ejection-time detecting section 46; a circulation-and-purging controller 44; and a maintenance controller 45.

The conveyance controller 41 controls the conveyance motor of the conveyance unit 20 such that the sheet P is conveyed in the conveyance direction at a predetermined speed. The image-data storage portion 42 stores therein image data relating to an image to be recorded on the sheet P.

In the normal recording, the head controller 43 produces an ejection driving signal on the basis of the image data and supplies the produced ejection driving signal to the actuator units 21. As shown in FIG. 9A, the ejection driving signal is a signal including a pulse that changes from an electric potential V1 to a ground potential V0 for a predetermined length of time in a single recording cycle. This pulse width t is equal to a length of time in which a pressure wave is transmitted through a distance AL (Acoustic Length) extending from an outlet of the sub-manifold channel 105*a* to the ejection opening 108. It is noted that a waveform in FIG. 9A is a waveform corresponding to ejection of a small ink droplet and having a single pulse. A waveform corresponding to a medium-size ink droplet is constituted by successive two pulses, and a waveform corresponding to a large ink droplet is constituted by successive three pulses.

On the basis of an ink ejection history, the non-ejection-time detecting section 46 detects, for each ink-jet head 1, an elapsed time from the last (most recent) ejection of the ink droplet from the ejection opening 108 to a current time. Specifically, the non-ejection-time detecting section 46 detects the elapsed time on the basis of the ejection driving signal outputted from the head controller 43 or the data stored in the image-data storage portion 42.

In the maintenance operation which will be described below, the circulation-and-purging controller 44 controls operations of the purging pump 86, the circulation valve 87, and the air communicating valve 88 of each ink supply unit 10. Specific controls of the circulation-and-purging controller 44 will be described below. It is noted that the circulation-and-purging controller 44 also controls the replenish pump 91 and the replenish valve 92 for the ink replenishing, but these are omitted in FIG. 8.

The maintenance controller 45 controls the maintenance unit 31 in the maintenance operation which will be described below.

Figure 10:
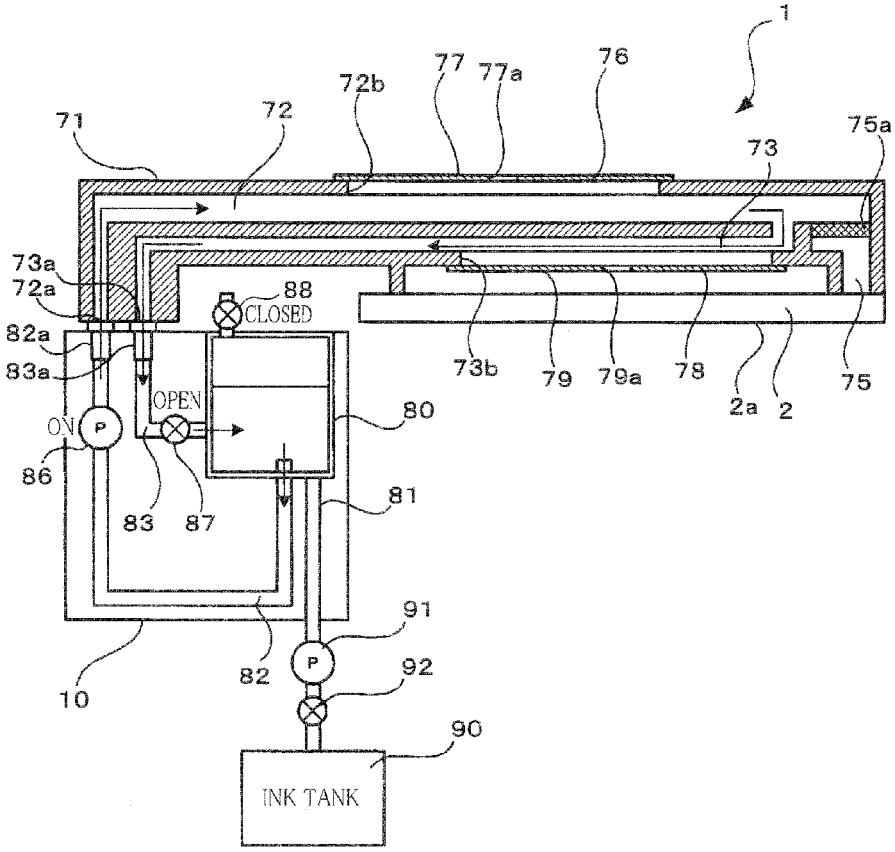
FIG. 10 is a view showing a flow of ink when the ink is circulated by a circulation-and-purging controller shown in FIG. 8.
Figure 11:
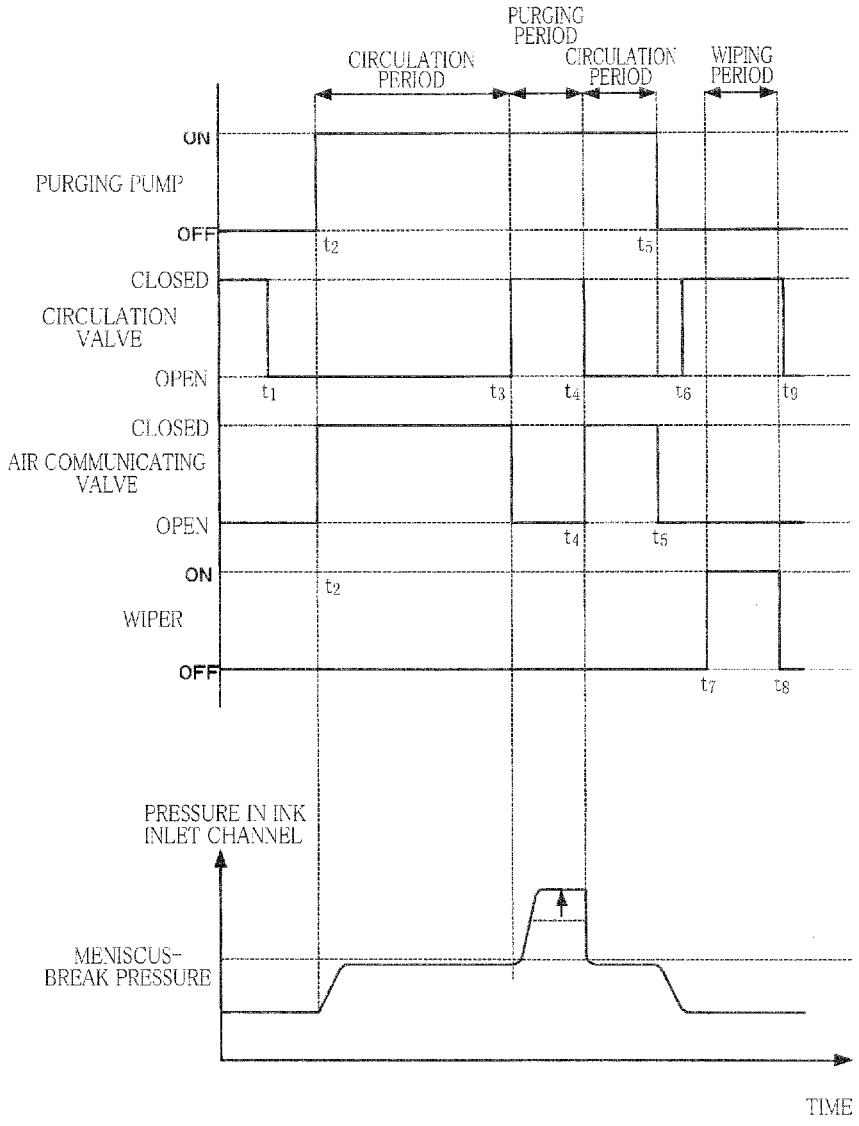
FIG. 11 is a view showing an operational sequence of the ink-jet printer shown in FIG. 1.
Figure 12:
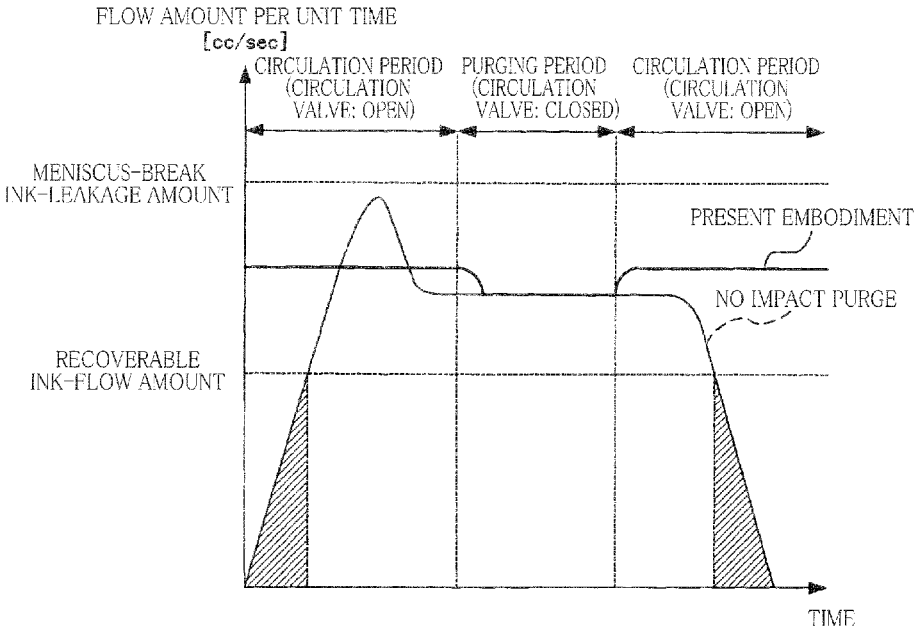
FIG. 12 is a graph showing changes of an ink-flow amount in a purging operation executed by the circulation-and-purging controller shown in FIG. 8.

There will be next explained the maintenance operation with reference to FIGS. 10-12. The maintenance operation is an operation for performing the maintenance of the ink-jet heads 1 and is started when the ink-jet printer 101 is booted up, when a standby time during which the recording has not been performed has passed a specific length of time, and when a command is inputted by a user, for example. During the standby state and the normal recording, the purging pump 86 is stopped, the circulation valve 87 is closed, the air communicating valve 88 is open, the replenish pump 91 is stopped, and the replenish valve 92 is closed (see FIG. 2).

As shown in FIGS. 10 and 11, when the maintenance operation is started, the circulation-and-purging controller 44 opens the circulation valve 87 at a time t1 and then closes the air communicating valve 88 and drives the purging pump 86 at the same time (at a time t2, a start of a circulation period or a liquid circulation control). It is noted that the replenish pump 91 is stopped, and the replenish valve 92 is closed during the maintenance operation.

As a result, the ink in the sub-tank 80 is forcibly supplied to the ink inlet channel 72 via the ink supply tube 82. Since the circulation valve 87 is open at this time, a channel resistance in a passage from the ink inlet channel 72 to the sub-tank 80 via the discharge channel 73 and the ink returning tube 83 is less than that in a passage from the ink inlet channel 72 to the ejection openings 108 via the ink outlet channels 75 and the manifold channels 105. Thus, the ink supplied to the ink inlet channel 72 passes through the discharge channel 73 and the ink returning tube 83 in order and returns to the sub-tank 80 (that is, the ink circulation is performed) without flowing into the ink outlet channels 75. When the ink circulation is performed, the pressure of the ink rises in a channel from the purging pump 86 to the sub-tank 80 in the circulation passage. Thus, by the ink flowing by the ink circulation, air bubbles and foreign matters remaining in the ink inlet channel 72, especially the air bubbles and the foreign matters built up on the filter 75*a*, are carried through the discharge channel 73 and the ink returning tube 83 in order together with the ink, so that the air bubbles and the foreign matters are trapped in the sub-tank 80.

In order to efficiently move the air bubbles and the foreign matters to the sub-tank 80 by the ink circulation, there is a need to increase an amount (an ink-flow amount) of the flow of the ink to be supplied from the purging pump 86 per unit time (hereinafter may be referred to as "unit-time supply amount") in a range not higher than an amount (meniscus-break ink-leakage amount) of the ink at a timing when the ink starts to leak or flow from the ejection openings 108 by a break of meniscus (meniscus break) of the ink in the ejection openings 108 (see FIG. 12). That is, the unit-time supply amount from the purging pump 86 during the ink circulation is increased as much as possible in a range in which the meniscus of the ink formed in the ejection openings 108 is not broken and the ink is not discharged from the ejection openings 108. It is noted that the meniscus-break ink-leakage amount is a value obtained by actual measurement or a value calculated from a channel structure of the ink-jet head 1, a height relationship between the ink-jet head 1 and the sub-tank 80 in the ink-jet printer 101, viscosity of the ink, and/or so on. The meniscus-break ink-leakage amount is stored in advance. It is noted that the unit-time supply amount from the purging pump 86 per unit time is set at an amount that is smaller than the meniscus-break ink-leakage amount and that is obtained by reducing a specific amount from the meniscus-break ink-leakage amount. This specific amount functions as a margin of the ink-flow amount such that the meniscus break does not occur even if a state of the meniscus has been changed by pulsation of the ink flow caused by the purging pump 86 and/or changes of environments such as ambient temperature and humidity. Further, when the purging operation is performed from the ejection openings 108 later, the ink flow in the discharge channel 73 is suddenly stopped or closed, whereby the ink pressures in the discharge channel 73 and the ink inlet channel 72 suddenly rise. The ink-flow amount per unit time is set at an amount equal to or larger than an ink amount (recoverable ink-flow amount) that can discharge the air bubbles and the foreign matters remaining in the individual ink channels 132 from the ejection openings 108 together with the ink by this rise of the ink pressures. It is noted that the recoverable ink-flow amount is a value obtained by actual measurement and stored in advance. From another point of view, where the driving of the purging pump 86 is started in the state in which the circulation valve 87 is closed such that the ink-flow amount is the recoverable ink-flow amount, an ink amount capable of discharging the air bubbles and the foreign matters remaining in the individual ink channels from all the ejection openings 108 together with the ink can be also referred to as the recoverable ink-flow amount. That is, where the purging pump 86 is driven with the ink whose ink amount is less than the recoverable ink-flow amount, the ink may continue to be discharged only from ejection openings 108 respectively communicating with individual ink channels 132 containing relatively small amounts of air bubbles and thickened or viscous ink. In this case, even if a period for discharging the ink is made longer, the ink may not be discharged from all the ejection openings 108 together with the air and the foreign matters.

As shown in FIG. 10, in the ink circulation, the ink pressures in the ink inlet channel 72 and the discharge channel 73 are relatively high when compared with in the normal recording, and accordingly the resin film 76 in the ink inlet channel 72 is held in close contact with the restraining member 77, and the resin film 78 in the discharge channel 73 is held in close contact with the restraining member 79.

In the period during which the air communicating valve 88 is closed in the ink circulation, a negative pressure is produced in the sub-tank 80. The ink in the ink inlet channel 72 is thus sucked into the sub-tank 80 via the discharge channel 73, making it difficult for the ink to flow into the ink outlet channels 75 when compared with the case where the air communicating valve 88 is open. As a result, the meniscus break is less likely to occur. Thus, when compared with the case where the air communicating valve 88 is open, the ink-flow amount per unit time can be made larger such that the pressure in the ink inlet channel 72 becomes closer to a pressure (meniscus-break pressure) at which the meniscus is broken. That is, assuming that the pressure in the ink inlet channel 72 is constant during the circulation, where the air communicating valve 88 is closed, the ink-flow amount is larger in the case where the air communicating valve 88 is open. Further, where the air communicating valve 88 is closed, the pressure in the ink inlet channel 72 during a purging period can be made larger than in the case where the air communicating valve 88 is open. Accordingly, it is possible to efficiently discharge the air bubbles and the foreign matters remaining in the individual ink channels from the ejection openings 108 together with the ink. This ink-flow amount per unit time is an amount during the ink circulation that is larger than a maximum amount (a first predetermined amount) in which the ink does not leak from the ejection openings 108 per unit time where the air communicating valve 88 is open and that is equal to or less than a maximum amount (a second predetermined amount) in which the ink does not leak from the ejection openings 108 per unit time where the air communicating valve 88 is closed. It is noted that, in FIG. 11, a solid-line waveform and a broken-line waveform indicate pressure changes in the ink inlet channel 72, specifically, the solid-line waveform indicates the pressure changes in the channel where the unit-time supply amount is made larger as described above in the state in which the air communicating valve 88 is closed during the ink circulation (i.e., in the case of the present embodiment), and the broken-line waveform indicates the pressure changes in the channel where the air communicating valve 88 is open during the ink circulation (noted that the unit-time supply amount is not made larger).

The purging operation (a liquid discharge control) is started, when the ink circulation has been performed for a length of time enough to remove the air bubbles and the foreign matters remaining in the ink inlet channel 72 from at least the ink inlet channel 72, in a state in which the ink-flow amount from the purging pump 86 per unit time is equal to or larger than the recoverable ink-flow amount. When the purging operation is started, as shown in FIGS. 11 and 12, the circulation-and-purging controller 44 closes the circulation valve 87 and opens the air communicating valve 88 at the same time (at a time t3). Thus, the ink flow in the discharge channel 73 is suddenly stopped by the circulation valve 87 (an end of the circulation period), whereby the ink pressures in the discharge channel 73 and the ink inlet channel 72 suddenly rise. As a result, the ink supplied to the ink inlet channel 72 flows into the ink outlet channels 75 without flowing into the discharge channel 73, and then the ink passes through the manifold channels 105 and the individual ink channels 132 in order and is discharged from the ejection openings 108 (a start of the purging period). The discharged ink is received by a waste-ink tray, not shown.

Since the purging operation is started by closing the circulation valve 87 in the state in which the ink circulation is being performed such that the ink-flow amount from the purging pump 86 per unit time is equal to or larger than the recoverable ink-flow amount (noted that this purging operation may be hereinafter referred to as "impact purge"), the ink pressure in the ink inlet channel 72 is relatively high from a point in time just after the purging operation is started, whereby the thickened ink in the ejection openings 108 and the remaining air bubbles and foreign matters can be efficiently discharged from the ejection openings 108. As shown in FIG. 12, if the impact purge is not performed, that is, if the purging pump 86 starts to be driven in the state in which the circulation valve 87 is closed without circulating the ink, to discharge the ink from the ejection openings 108 (a conventional technique), a length of time required for an ink pressure in each of the individual ink channels 132 to exceed a pressure at which the ink is discharged from all the ejection openings 108 becomes longer, and, until the length of time has been passed, the ink is needlessly discharged from the ejection openings 108. That is, since the ink is discharged from only the ejection openings 108 respectively communicating with the individual ink channels 132 containing relatively small amounts of air bubbles and thickened ink, the ink is discharged unnecessarily. Further, in the above-described embodiment, the circulation valve 87 is closed, and the air communicating valve 88 is opened simultaneously. Thus, the pressure in the sub-tank 80 forcibly becomes the atmospheric pressure, thereby preventing the pressure in the sub-tank 80 from lowering in accordance with the discharging of the ink. Where the communication of the sub-tank 80 with the ambient air is interrupted when the ink is discharged, the ink does not flow into the sub-tank 80, and accordingly a large amount of the negative pressure may be produced in the sub-tank 80 when the ink is discharged, thereby hindering the operation of the purging pump 86, but where the sub-tank 80 is communicated with the ambient air when the ink is discharged, it is possible to avoid the hindrance to the operation of the purging pump 86.

When the predetermined purging amount of the ink has been ejected from the ejection openings 108 after the start of the purging operation, the circulation-and-purging controller 44 stops the purging operation by opening the circulation valve 87 and closing the air communicating valve 88 at the same time again at a time t4 (an end of the purging period). Since the ink supply by the purging pump 86 is continued, the ink circulation is started again concurrently with the stop of the purging operation. It is noted that the predetermined purging amount is determined by the ink-flow amount of the purging pump 86 per unit time and a length of the purging period. The ink-flow amount per unit time and the length of the purging period for discharging the predetermined purging amount of the ink are obtained by experiment and stored in advance. The circulation-and-purging controller 44 makes the circulation period longer and the purging amount larger in accordance with increase in a temperature detected by a temperature sensor 35 or increase in a length of the elapsed time detected by the non-ejection-time detecting section 46.

The circulation-and-purging controller 44 then stops the purging pump 86 and opens the air communicating valve 88 at the same time at a time t5. As a result, the ink circulation is stopped. The circulation-and-purging controller 44 then closes the circulation valve 87 at a time t6. As thus described, the air communicating valve 88 is closed during the entire circulation period in which the ink circulation is performed (i.e., times t2-t3 and t4-t5).

As described above, by performing the ink circulation and the purging operation in order, the air bubbles and the foreign matters remaining in the ink inlet channel 72 can be discharged to an outside of the ink-jet heads 1 without flowing into downstream-side channels (e.g., the manifold channels 105, the individual ink channels 132, and the like).

Then, when the wiping operation has been started, the maintenance controller 45 moves the four ink-jet heads 1 upward by a moving mechanism, not shown, and then moves the four wiper members 32 in the main scanning direction along the ejection faces 2*a* respectively facing thereto while holding distal ends of the respective wiper members 32 in contact with the respective ejection faces 2*a*. This operation removes the excessive ink adhering to the ejection faces 2*a* by the purging operation and recovers or arranges the state of the ink meniscus formed in the ejection openings 108. After the ejection faces 2*a* have been wiped, the maintenance controller 45 returns the four wiper members 32 and the ink-jet heads 1 to their respective original positions, and the circulation-and-purging controller 44 opens the circulation valve 87, and the wiping operation is completed.

As described above, according to the ink-jet printer 101 as the present embodiment, performing the ink circulation increases the pressure in the channel extending from the purging pump 86 to the sub-tank 80 in the circulation passage. In this ink circulation, the air communicating valve 88 is closed to inhibit the communication of the inside of the sub-tank 80 with the ambient air, thereby making it difficult for the ink in the channels to flow into the ink outlet channels 75. As a result, the ink is less likely to leak from the ejection openings 108. The circulation valve 87 is closed in this state, thereby making it possible to discharge the ink from the ejection openings 108 by momentarily raising the pressures in the channels. As a result, a relatively high pressure is applied to all the ejection openings 108 from the start of the purging operation to discharge the ink in the ejection openings 108. Accordingly, it is possible to efficiently discharge the thickened ink in the ejection openings 108, the air bubbles, and the foreign matters, and it is possible to prevent the ink from being discharged needlessly.

Further, the ink-flow amount per unit time in the ink circulation is larger than the maximum ink-flow amount in which the ink does not leak from the ejection openings 108 when the air communicating valve 88 is open, and the ink-flow amount per unit time in the ink circulation is equal to or less than the maximum amount in which the ink does not leak from the ejection openings 108 when the air communicating valve 88 is closed. This makes it possible to increase the ink-flow amount per unit time in the ink circulation, whereby the pressures in the channels can be momentarily increased in the ink discharging. Accordingly, it is possible to reliably discharge the ink from the ejection openings 108 while preventing the unnecessary ink discharging.

Further, since the air communicating valve 88 is closed in the entire circulation period in which the ink circulation is performed, the pressure in the sub-tank 80 becomes the negative pressure at the start of the ink circulation, thereby preventing the ink from leaking from the ejection openings 108 during the entire period of the ink circulation.

Further, since the circulation valve 87 is closed, and the air communicating valve 88 is opened at the same time when the purging operation is started in the ink circulation, the pressure of the inside of the sub-tank 80 forcibly becomes the atmospheric pressure, thereby preventing the pressure in the sub-tank 80 from lowering in accordance with the discharging of the ink. Accordingly, the ink supply of the purging pump 86 to the ink outlet channels 75 is not hindered. As a result, it is possible to prevent the ink discharging from the ejection openings 108 from being unstable or stopped.

Further, in the above-described embodiment, the ink discharging from the ejection openings 108 is stopped by opening the circulation valve 87 and closing the air communicating valve 88 when the ink is discharged by the purging operation. Accordingly, it is possible to quickly stop discharging the ink from the ejection openings 108, and it is possible to prevent the ink from leaking from the ejection openings 108 by producing the negative pressure in the sub-tank 80.

Further, after the ink discharging from the ejection openings 108 is stopped, the purging pump 86 is stopped, and the air communicating valve 88 is opened at the same time. Thus, the pressure in the sub-tank 80 does not become the negative pressure after the ink discharging from the ejection openings 108 is stopped, thereby preventing the ink adhering to the ejection face 2*a* from being sucked into the ejection openings 108.

Further, in the above-described embodiment, the circulation valve 87 is closed after the purging pump 86 is stopped. Accordingly, it is possible to prevent the ink having adhered to the ejection face 2*a* by the purging operation from being sucked into the ejection openings 108 by, e.g., the water head difference between the ink-jet head 1 and the sub-tank 80.

Further, in the above-described embodiment, the wiping operation is performed after the end of the purging operation. Accordingly, it is possible to remove the ink and the foreign matters adhering to the ejection faces 2*a* and to recover or arrange the state of the ink meniscus of the ejection openings 108.

Further, in the above-described embodiment, the resin film 76 partly constitutes the inner wall face of the ink inlet channel 72, and the resin film 78 partly constitutes the inner wall face of the discharge channel 73. Thus, it is possible to efficiently restrain the changes of the ink pressures in the ink inlet channel 72 and the discharge channel 73. Accordingly, the ink can be supplied to the individual ink channels at a stabilized pressure. Further, when the resin films 76, 78 are deformed in the ink circulation, a volume of the channel increases, lowering the pressure in the sub-tank 80. Accordingly, the ink is less likely to leak from the ejection openings 108.

First Modification

Figure 13:
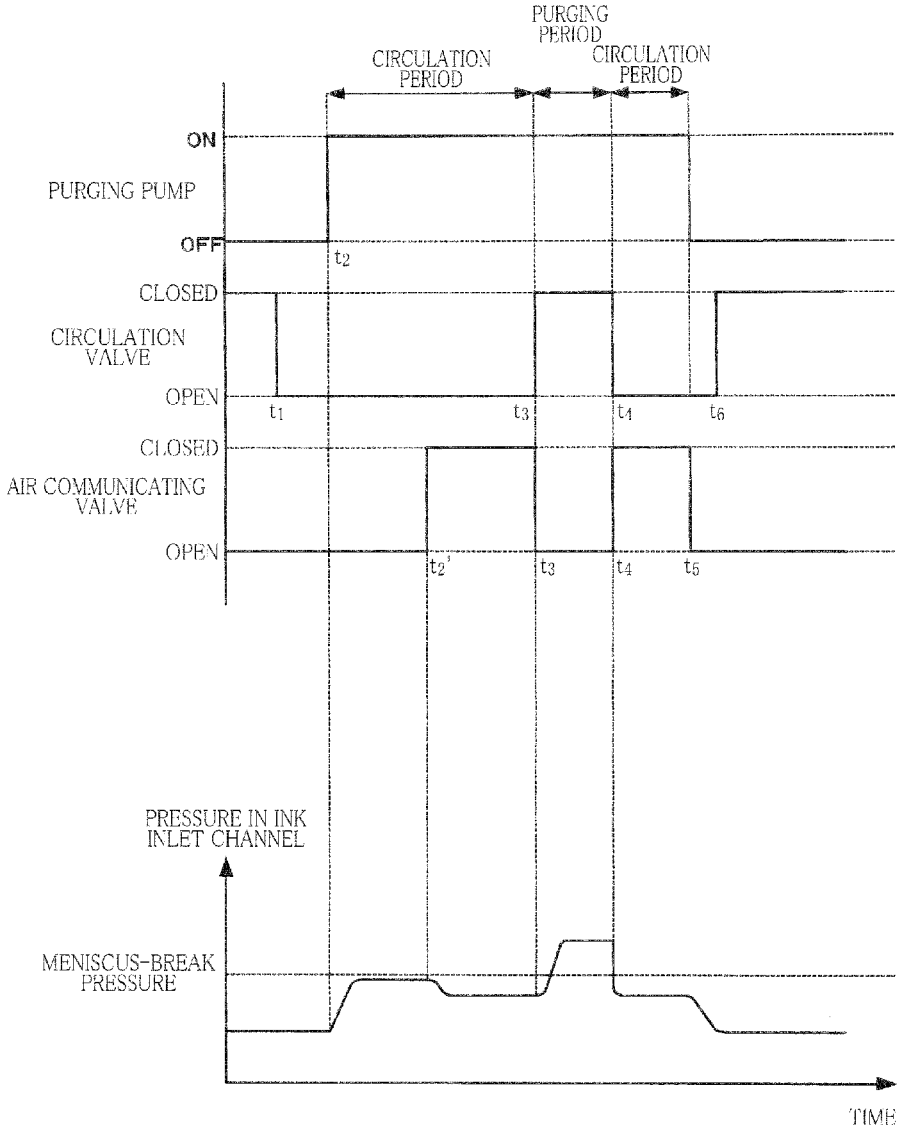
FIG. 13 is a view showing an operational sequence of an ink-jet printer as a first modification of the first embodiment.

There will be next explained a first modification of the present embodiment. In the above-described embodiment, when the ink circulation is started, the purging pump 86 starts to be driven at the same time when the air communicating valve 88 is closed, but as shown in FIG. 13, the printer 101 may be configured such that, when the ink circulation is started, the purging pump 86 starts to be driven in a state in which the air communicating valve 88 is open, and then the air communicating valve 88 is closed at a time t2'. In this case, assuming that the ink supply amounts from the purging pump 88 in the following two cases are the same as each other, a pressure in the channel from the purging pump 86 to the sub-tank 80 in the circulation passage in a period in which the air communicating valve 88 is open in the circulation period is larger than that in a period in which the air communicating valve 88 is closed. In this case, the purging pump 86 is preferably driven in a state in which the pressure in the channel in the period in which the air communicating valve 88 is open is not larger than the meniscus-break pressure, that is, in a state in which the ink does not leak from the ejection openings 108.

Second Modification

Figure 14:
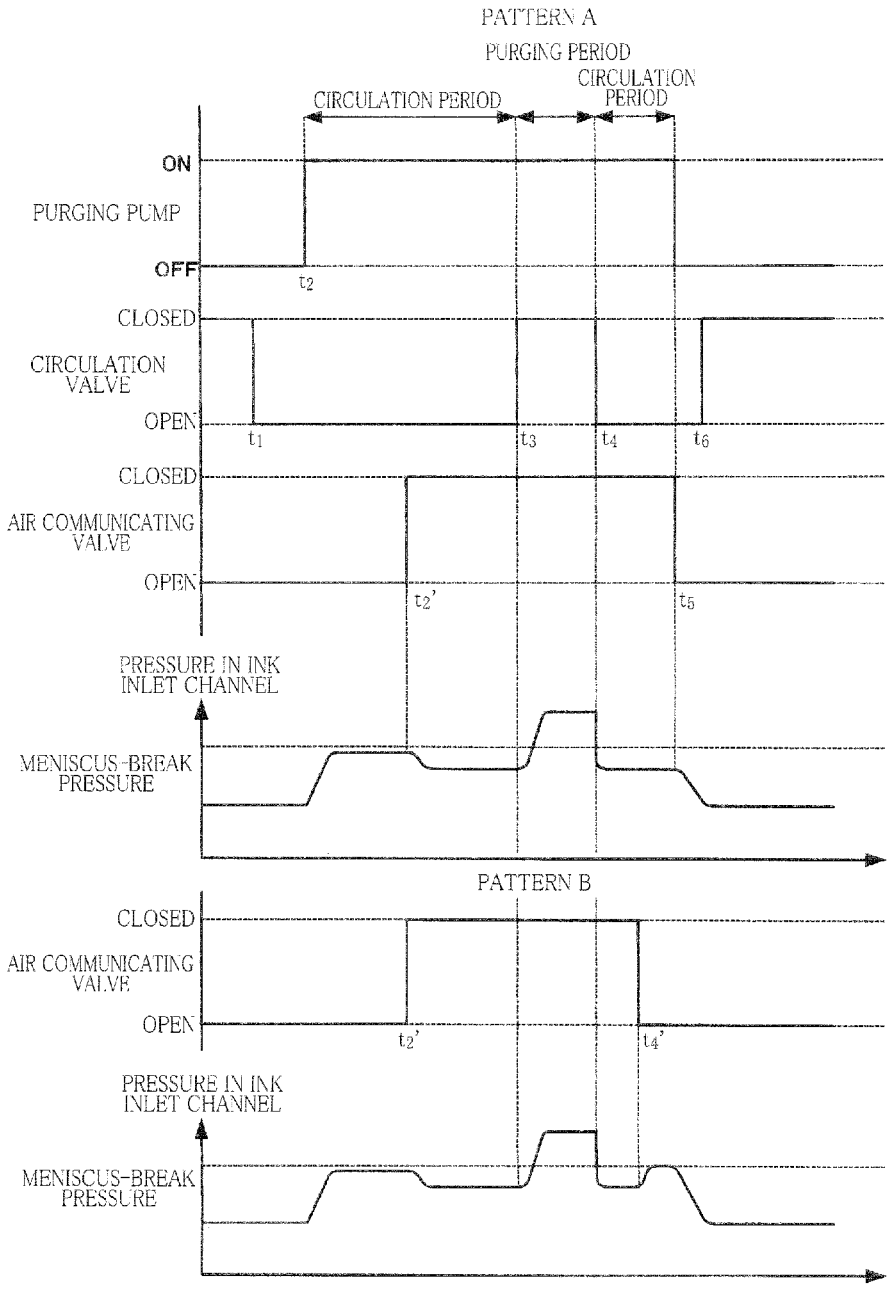
FIG. 14 is a view showing an operational sequence of an ink-jet printer as a second modification of the first embodiment.

There will be next explained a second modification of the present embodiment with reference to FIG. 14. It is noted that, in FIG. 14, the same operations of the purging pump 86 and the circulation valve 87 in a pattern A are performed in a pattern B. In the above-described embodiment, the air communicating valve 88 is closed in the entire circulation period and open in the entire purging period, but as shown in FIG. 14, the air communicating valve 88 may be closed during the purging period. For example, as shown in the pattern A in FIG. 14, the air communicating valve 88 may be closed during an entire period from some midpoint of the circulation period before the purging operation to the end of the circulation period after the purging operation, or as shown in the pattern B in FIG. 14, the air communicating valve 88 may be closed during a period from some midpoint of the circulation period before the purging operation to some midpoint of the circulation period after the purging operation. It is noted that the air communicating valve 88 may be closed during only a part of the purging period. Also in these cases, a pressure in the channel from the purging pump 86 to the sub-tank 80 in the circulation passage is increased by the ink circulation. When the circulation valve 87 is closed in this the state, the pressure in the channel is momentarily raised, thereby discharging the ink from the ejection openings 108. As a result, a relatively high pressure is applied to all the ejection openings 108 from the start of the purging operation to discharge the ink in the ejection openings 108. Accordingly, it is possible to efficiently discharge the thickened ink in the ejection openings 108, the air bubbles, and the foreign matters, and it is possible to prevent the ink from being discharged needlessly. Further, in the period in which the air communicating valve 88 is closed to inhibit the communication of the inside of the sub-tank 80 with the ambient air in the ink circulation, the ink in the channel is less likely to flow into the ink outlet channels 75. As a result, the ink is less likely to leak from the ejection openings in this period, thereby further preventing the unnecessary ink discharging.

Third Modification

Figure 15:
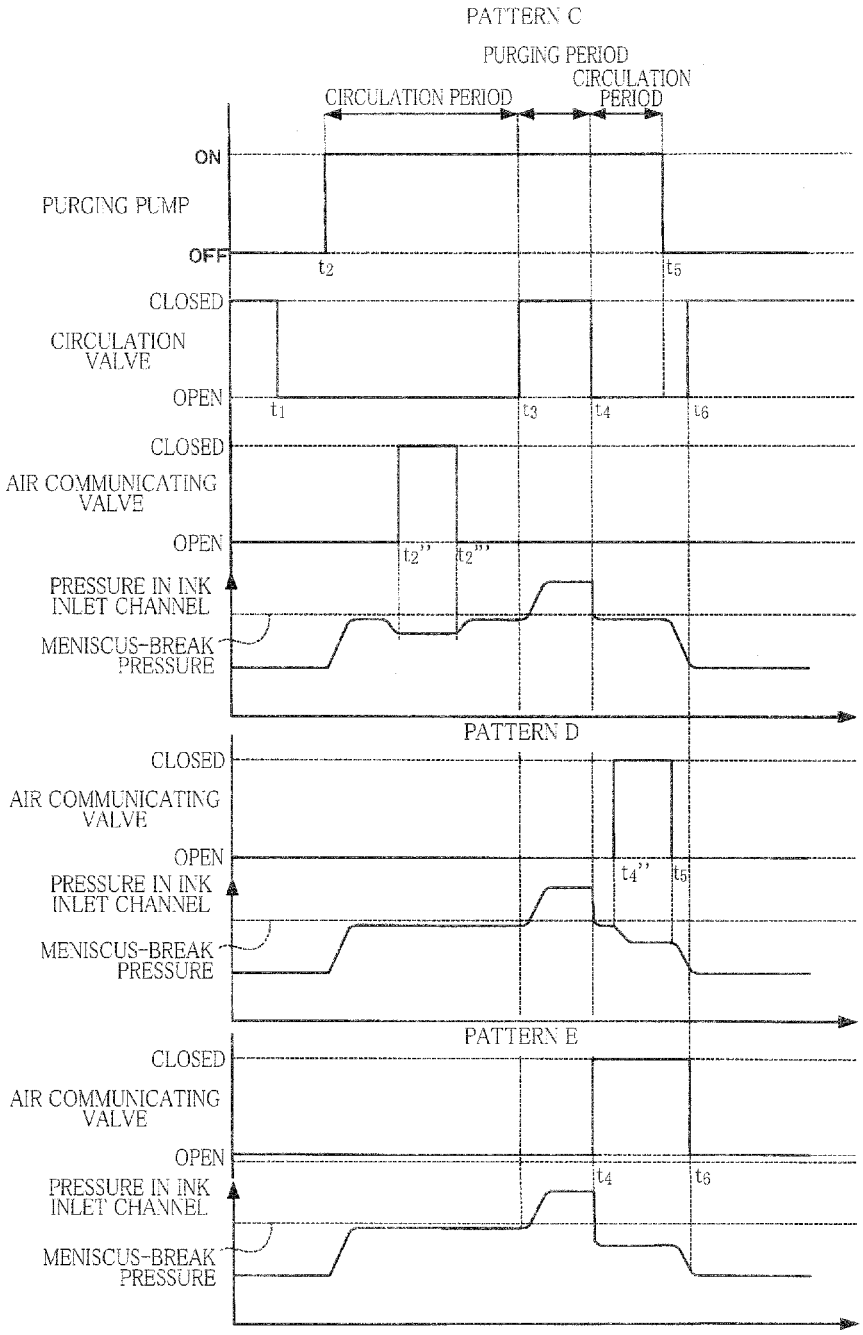
FIG. 15 is a view showing an operational sequence of an ink-jet printer as a third modification of the first embodiment.

There will be next explained a third modification of the present embodiment with reference to FIG. 15. It is noted that, in FIG. 15, the same operations of the purging pump 86 and the circulation valve 87 in a pattern C are performed in patterns D and E. In the above-described embodiment, the air communicating valve 88 is closed in the entire circulation period, but as shown in FIG. 15, the air communicating valve 88 may be closed during only a part of the circulation period. For example, as shown in the pattern C in FIG. 15, the air communicating valve 88 may be closed during only a part of the circulation period before the purging operation, or as shown in the pattern D in FIG. 15, the air communicating valve 88 may be closed during only a part of the circulation period after the purging operation, or as shown in the pattern E in FIG. 15, the air communicating valve 88 may be closed during only a period from the start of the circulation period after the purging operation to the point in time when the circulation valve 87 is closed. Further, the air communicating valve 88 may be closed during only the entire circulation period before the purging operation. It is noted that the period in which the air communicating valve 88 is closed and the purging period may or may not be continuous to each other. That is, the period in which the air communicating valve 88 is closed is determined with consideration of a timing for preventing the ink leakage from the ejection openings 108. Also in these cases, the pressure in the channel from the purging pump 86 to the sub-tank 80 in the circulation passage is increased by the ink circulation. When the circulation valve 87 is closed in this state, the pressure in the channel is momentarily raised, thereby discharging the ink from the ejection openings 108. As a result, a relatively high pressure is applied to all the ejection openings 108 from the start of the purging operation to discharge the ink in the ejection openings 108. Accordingly, it is possible to efficiently discharge the thickened ink in the ejection openings 108, the air bubbles, and the foreign matters, and it is possible to prevent the ink from being discharged needlessly. Further, in the period in which the air communicating valve 88 is closed to inhibit the communication of the inside of the sub-tank 80 with the ambient air in the ink circulation, the ink in the channel is less likely to flow into the ink outlet channels 75. As a result, the ink is less likely to leak from the ejection openings in this period, thereby further preventing the unnecessary ink discharging.

Fourth Modification

Figure 16:
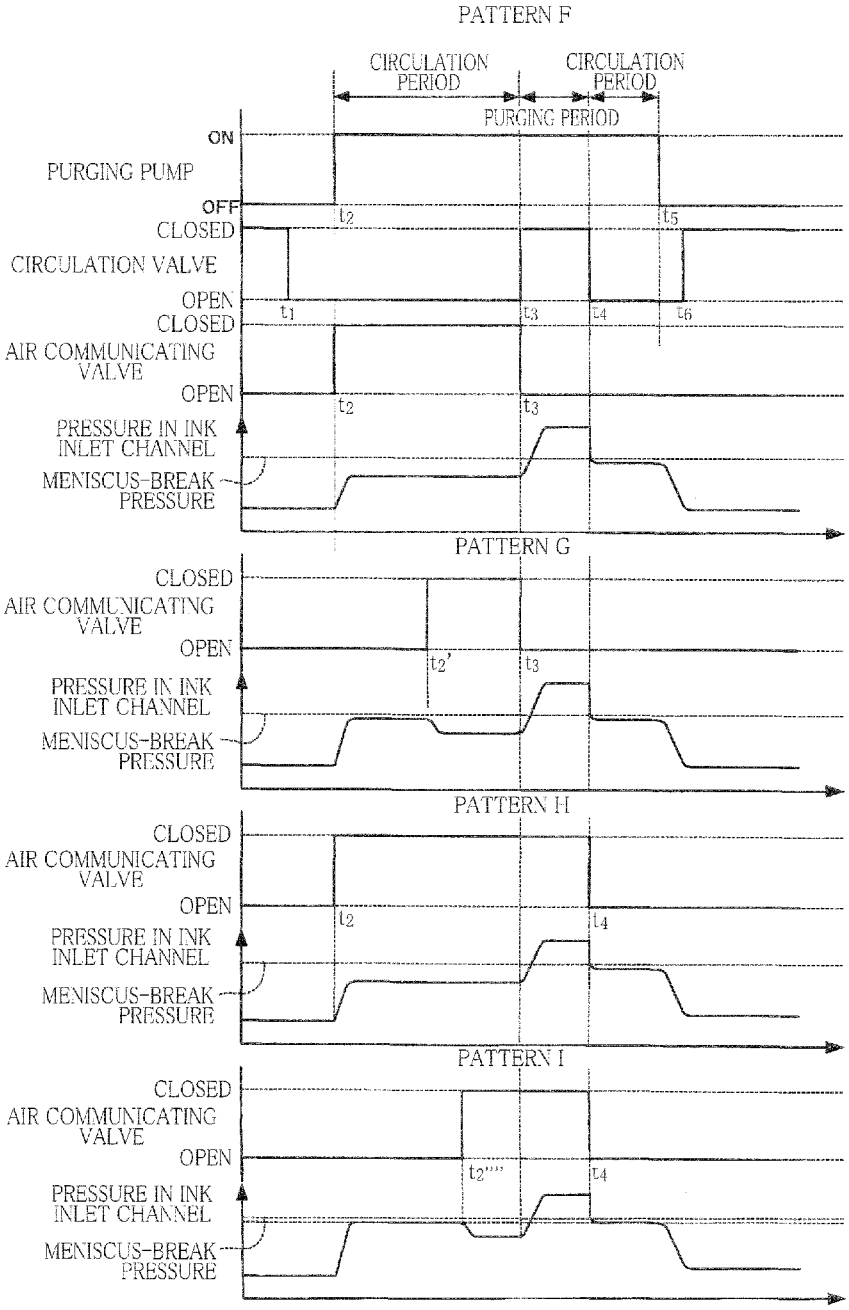
FIG. 16 is a view showing an operational sequence of an ink-jet printer as a fourth modification of the first embodiment.

There will be next explained a fourth modification of the present embodiment with reference to FIG. 16. It is noted that, in FIG. 16, the same operations of the purging pump 86 and the circulation valve 87 in a pattern F are performed in patterns G, H, and I. In the above-described embodiment, the air communicating valve 88 is closed at the end of the purging operation, but as shown in FIG. 16, the air communicating valve 88 may be open after the end of the purging operation. For example, as shown in the pattern F in FIG. 16, the printer 101 may be configured such that the air communicating valve 88 is closed during the entire circulation period before the purging operation and is open during the other periods. Further, as shown in the pattern G in FIG. 16, the printer 101 may be configured such that the air communicating valve 88 is closed during a part of the circulation period before the purging operation and is open during the other periods. Further, as shown in the pattern H in FIG. 16, the printer 101 may be configured such that the air communicating valve 88 is closed during the circulation period before the purging operation and the purging period and is open during the other periods. Further, as shown in a pattern I in FIG. 16, the printer 101 may be configured such that the air communicating valve 88 is closed during a part of the circulation period before the purging operation and the purging period and is open during the other periods. Also in these cases, the pressure in the channel from the purging pump 86 to the sub-tank 80 in the circulation passage is increased by the ink circulation. When the circulation valve 87 is closed in this state, the pressure in the channel is momentarily raised, thereby discharging the ink from the ejection openings 108. As a result, a relatively high pressure is applied to all the ejection openings 108 from the start of the purging operation to discharge the ink in the ejection openings 108. Accordingly, it is possible to efficiently discharge the thickened ink in the ejection openings 108, the air bubbles, and the foreign matters, and it is possible to prevent the ink from being discharged needlessly. Further, in the period in which the air communicating valve 88 is closed to inhibit the communication of the inside of the sub-tank 80 with the ambient air in the ink circulation, the ink in the channel is less likely to flow into the ink outlet channels 75. As a result, the ink is less likely to leak from the ejection openings in this period, thereby further preventing the unnecessary ink discharging.

Second Embodiment

Figure 17:
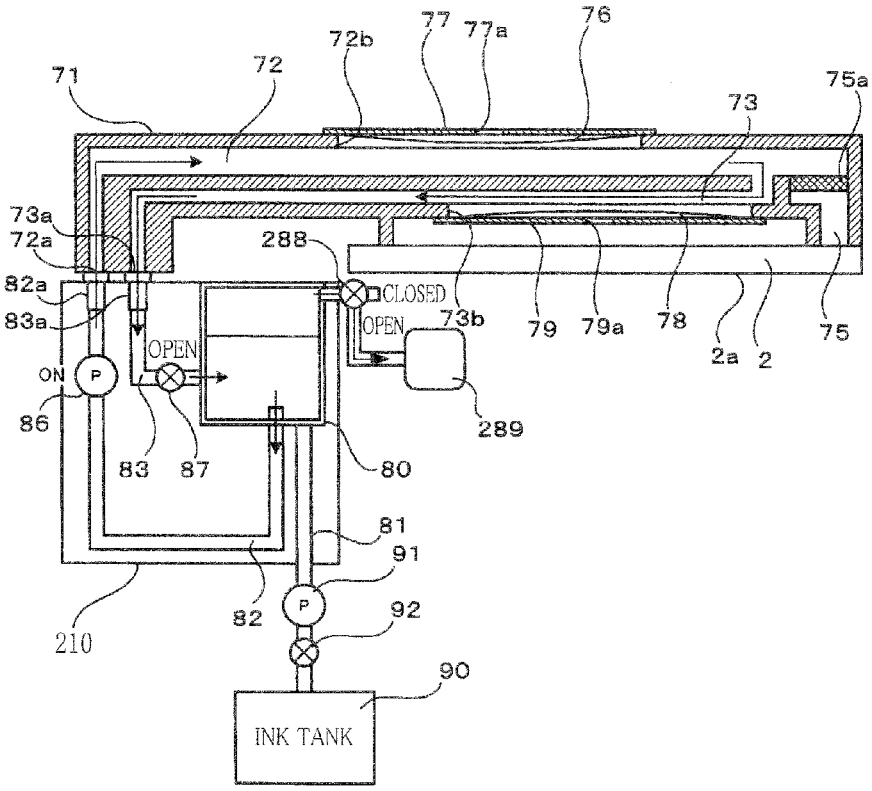
FIG. 17 is a view for explaining a second embodiment of the present invention.

There will be next explained a second embodiment of the present invention. In this second embodiment, the same reference numerals as used in the illustrated first embodiment are used to identify the corresponding components and functioning sections, and a detailed explanation of which is dispensed with. As shown in FIG. 17, an ink supply unit 210 includes: the sub-tank 80; the ink replenish tube 81; the replenish pump 91 and the replenish valve 92 provided on the ink replenish tube 81; the ink supply tube 82; the ink returning tube 83; the purging pump 86; the circulation valve 87; a communication valve 288 connected to the sub-tank 80; and a negative-pressure tank 289. The communication valve 288 communicates the inside of the sub-tank 80 with the ambient air or the negative-pressure tank 289 selectively (that is, the communication valve 288 functions as an air communication device and an negative-pressure communicating device). The negative-pressure tank 289 is a negative-pressure producing device configured to produce an air pressure that is lower than the atmospheric pressure. The circulation-and-purging controller communicates the inside of the sub-tank 80 with the negative-pressure tank 289 at a timing when the inside of the sub-tank 80 is interrupted from the ambient air in the first embodiment.

According to the present embodiment, during the ink circulation, the communication of the inside of the sub-tank 80 with the ambient air is inhibited, and the sub-tank is communicated with the negative-pressure tank 289, whereby the pressure in the sub-tank 80 becomes the negative pressure quickly and reliably. As a result, the ink in the channel from the purging pump 86 to the sub-tank 80 in the circulation passage is sucked into the sub-tank 80, making it more difficult for the ink to flow into the ink outlet channels 75. Thus, the ink is less likely to leak from the ejection openings 108, and the ink discharging pressure in the impact purge can be increased by increasing the ink-flow amount in the ink circulation per unit time.

Third Embodiment

Figure 9B:
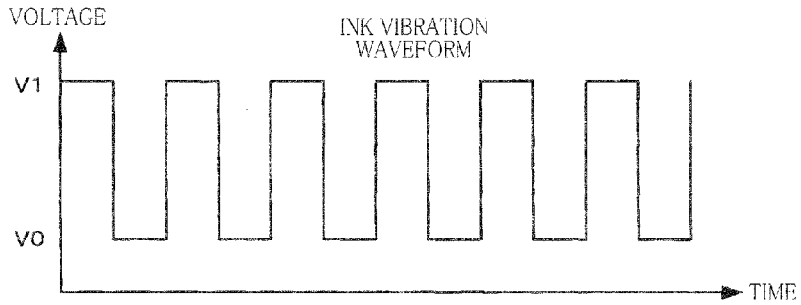
FIG. 9B is a waveform chart of an ink vibration signal produced by the head controller.

There will be next explained a third embodiment of the present invention. In this third embodiment, the same reference numerals as used in the illustrated first embodiment are used to identify the corresponding components and functioning sections, and a detailed explanation of which is dispensed with. It is noted that, in the present embodiment, as shown in FIG. 9B, in the maintenance operation which will be described below, the head controller 43 supplies, to the actuator units 21, ink vibration signals for vibrating the ink in all the individual ink channels 132 without leakage of the ink from the ejection openings 108 (noted that this vibration may be hereinafter referred to as "ink vibration"). It is noted that, as shown in FIG. 9B, the ink vibration signal is a signal in which the pulse that changes from the electric potential V1 to the ground potential V0 for the predetermined length of time is repeated in predetermined cycles. A width of this pulse is preferably equal to or less than one-third of a length of time required for the pressure wave to be transmitted through the distance AL.

Figure 19:
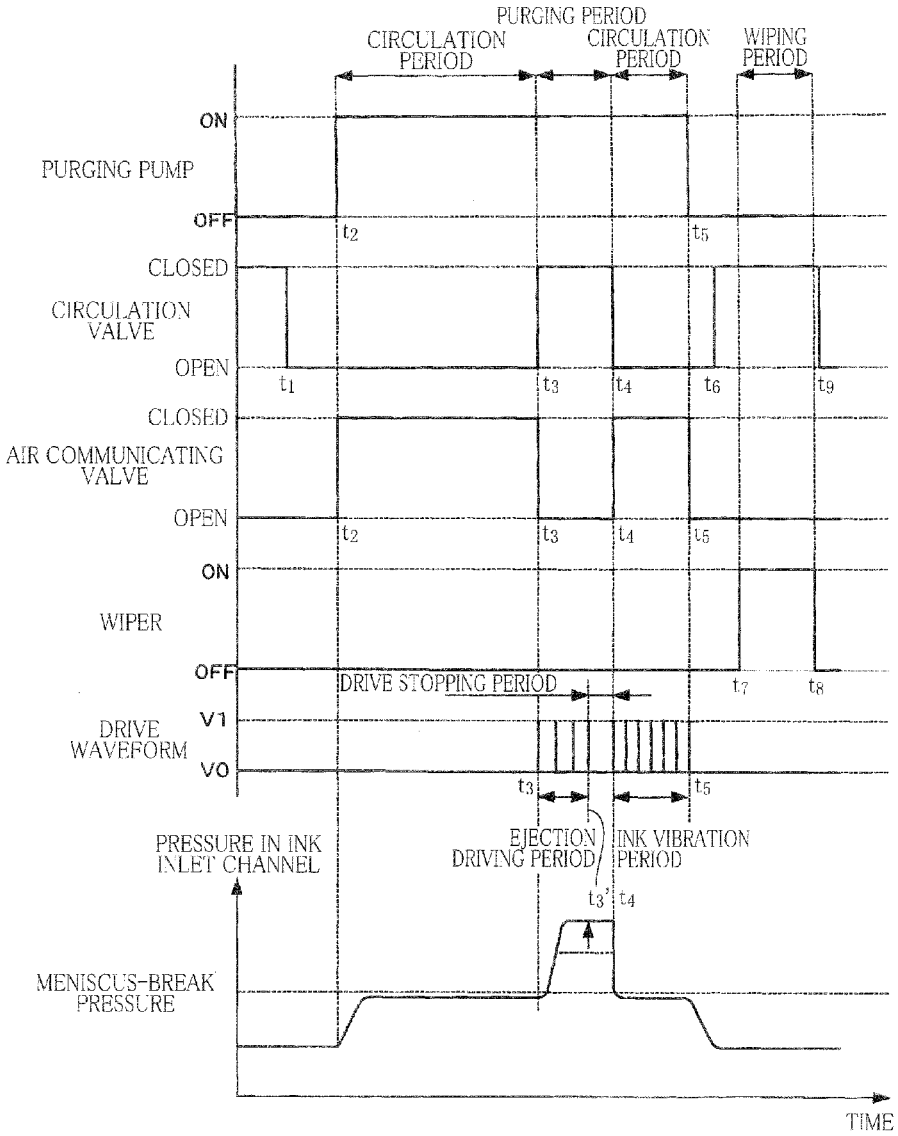
FIG. 19 is a view showing an operational sequence of an ink-jet printer as a third embodiment.

Further, as shown in FIG. 19, concurrently with the start of the purging operation at a time T3, the head controller 43 starts to successively supply the ejection driving signals for the small droplet to the actuator units 21 (a start of an ejection driving period). As a result, pressures enough to eject the ink droplets from the ejection openings 108 are successively applied to the ink in all the individual ink channels 132 (as one example of a pressure vibration applied to the ink in the individual ink channels 132). Thus, pressure vibrations are applied to the ink in the individual ink channels 132, whereby the air bubbles and the foreign matters adhering to wall faces of the individual ink channels 132 (i.e., faces respectively defining the individual ink channels 132) are peeled or removed from the wall faces and float in the ink. The air bubbles and the foreign matters peeled from the wall faces are discharged from the ejection openings 108 together with the ink by the ink flow generated by the purging operation. After a predetermined length of time has passed from the start of the successive supply of the ejection driving signals (at a time T3'), the head controller 43 stops the successive supply of the ejection driving signals to the actuator units 21 (an end of the ejection driving period). For a period from the end of the ejection driving period (the time t3') to a point in time when a predetermined purging amount of the ink has been discharged from the ejection openings 108 (a time t4), the head controller 43 stops supplying the drive signals (including the ejection driving signal and the ink vibration signal) to the actuator units 21 (the drive stopping period).

When the predetermined purging amount of the ink has been ejected from the ejection openings 108 after the start of the purging operation, the circulation-and-purging controller 44 stops the purging operation by opening the circulation valve 87 and closing the air communicating valve 88 at the same time again at a time t4 (an end of the purging period). Since the ink supply by the purging pump 86 is continued, the ink circulation is started again concurrently with the stop of the purging operation. It is noted that the predetermined purging amount is determined by the ink-flow amount of the purging pump 86 per unit time and a length of the purging period. The ink-flow amount per unit time and the length of the purging period for discharging the predetermined purging amount of the ink are obtained by experiment and stored in advance. The circulation-and-purging controller 44 makes the circulation period longer and the purging amount larger in accordance with increase in a temperature detected by the temperature sensor 35 or increase in a length of the elapsed time detected by the non-ejection-time detecting section 46.

When the purging period is ended, the head controller 43 starts to supply the ink vibration signals at the time t4 as another example of a pressure vibration applied to the ink in the individual ink channels 132 (a start of an ink vibration period). As a result, just after the purging operation is stopped, the ink flow in the individual ink channels 132 is quickly put in good order, preventing the ink from needlessly leaking from the ejection openings 108.

The circulation-and-purging controller 44 then stops the purging pump 86 and opens the air communicating valve 88 at the same time at a time t5. As a result, the ink circulation is stopped. Further, at the same time, the head controller 43 stops supplying the ink vibration signals to the actuator units 21 (an end of the ink vibration period). The circulation-and-purging controller 44 then closes the circulation valve 87 at a time t6. As thus described, the air communicating valve 88 is closed during the entire circulation period in which the ink circulation is performed.

Further, in the purging period, the pressure vibrations are applied to the ink in all the individual ink channels 132. As a result, the air bubbles and the foreign matters adhering to the wall faces of the individual ink channels 132 are peeled from the wall faces, making it easier to discharge the air bubbles and the foreign matters. Thus, discharging properties of the ejection openings 108 can be made uniform. This further prevents the unnecessary ink discharging and makes it possible to efficiently discharge the thickened ink in the ejection openings 108, the air bubbles, and the foreign matters.

Further, the head controller 43 starts to successively supply the ejection driving signals to the actuator units 21 at the same time when (or just before) the circulation-and-purging controller 44 stops the ink circulation by closing the circulation valve 87. Thus, the application of the pressure vibrations to the ink in the individual ink channels 132 is started concurrently with the start of the purging operation. Thus, the air bubbles and the foreign matters adhering to the wall faces of the individual ink channels 132 are peeled from the wall faces at the start of the ink discharging from the ejection openings 108, making it easier to discharge the ink. As a result, it is possible to decrease the number of ejection openings 108 from which the ink is hard to be discharged, thereby uniforming the discharging properties of the ejection openings 108. As a result, the ink can be uniformly and stably discharged from all the ejection openings 108 from the start of the discharging, thereby preventing the unnecessary ink discharging.

Further, in the purging period, the drive stopping period is provided after the end of the ejection driving period. Thus, in the drive stopping period, the head controller 43 does not supply the ejection driving signal to the actuator unit 21, so that new pressure vibrations do not occur in the individual ink channels 132. This makes it possible to prevent the pressure vibrations from being exerted in a direction in which the ink in the individual ink channels 132 is not discharged from the ejection openings 108. As a result, the air bubbles and the foreign matters peeled from the wall faces of the individual ink channels 132 in the ejection driving period can be efficiently discharged from the ejection openings 108 in the drive stopping period.

Further, the head controller 43 supplies the ejection driving signals to the actuator units 21 in the ejection driving period for ejecting the small ink droplets from the ejection openings 108. Thus, the ink discharging from the ejection openings 108 is promoted in the purging period, thereby further uniforming the discharging properties in the ejection openings 108.

Further, the head controller 43 starts to supply the ink vibration signals to the actuator units 21 at the same time when the purging period is ended. The ink flow in the individual ink channels 132 is quickly put in order just after the purging operation is stopped, thereby preventing the ink from leaking from the ejection openings 108 needlessly.

Further, each of the actuator units 21 is provided by the piezoelectric actuator that generates the ejection energy for ejecting ink droplets from the ejection openings 108 and the vibration energy for vibrating the ink in the individual ink channels 132. Thus, there is no need to provide another mechanism for generating the vibration energy, thereby lowering a cost of the ink-jet head 1.

While the embodiments and the modifications of the present invention have been described above, it is to be understood that the invention is not limited to the details of the illustrated embodiments and modifications, but may be embodied with various changes and modifications, which may occur to those skilled in the art, without departing from the spirit and scope of the invention. For example, in the above-described embodiments, the circulation valve 87 is selectively opened or closed, but a channel controlling valve capable of changing the channel resistance value at any value may be employed as the circulation valve 87. In this case, the channel controlling valve may change the channel resistance value so as to change the channel resistance value stepwise or continuously. Further, the circulation valve 87 does not need to close the ink channel completely. Further, in the above-described embodiment, the channel resistance value of the ink returning tube 83 is adjusted by controlling the circulation valve so as to reduce a cross-sectional area of the ink channel of the ink returning tube 83, but, in order to adjust the channel resistance value of the ink returning tube 83, an outer circumferential face of the ink returning tube 83 may be pinched by a pinching member to deform the ink returning tube 83 so as to reduce the cross-sectional area of the ink channel of the ink returning tube 83.

Further, in the above-described embodiments, when the air communicating valve 88 is closed, the communication of the inside of the sub-tank 80 with the ambient air is completely interrupted, but the inside of the sub-tank 80 and the ambient air may communicate with each other through a slight clearance in a state in which the air communicating valve 88 is closed, as long as a negative pressure is produced in the sub-tank 80 during the ink circulation.

Further, in the above-described embodiments, the purging operation is stopped by opening the circulation valve 87 in the purging operation in the state in which the purging pump 86 is driven. The purging operation may be stopped by stopping the purging pump 86 in a state in which the circulation valve 87 is closed.

Further, in the above-described embodiments, the wiping operation is performed in the maintenance operation, but the wiping operation may be omitted.

In addition, in the above-described embodiments, the resin film 76 partly constitutes the inner wall face of the ink inlet channel 72, and the resin film 78 partly constitutes the inner wall face of the discharge channel 73, but the reservoir unit may not include at least one of the resin films 76, 78.

Further, in the above-described embodiments, the ink-flow amount from the purging pump 86 per unit time during the ink circulation is smaller than the meniscus-break ink-leakage amount, but the ink-flow amount may be equal to or larger than the meniscus-break ink-leakage amount as long as an amount of the ink leaking from the ejection openings 108 during the ink circulation is very small. For example, where the ink is leaking from only a small number of the ejection openings, the meniscus break occurs in the ejection openings, but an amount of the leaking ink is so small that effects for preventing the ink from being consumed needlessly can be obtained as a whole.

Further, in the above-described embodiments, the purging pump 86 is provided by the three-phase diaphragm pump as one of the volume pumps, but may be another volume pump such as a tube pump and may be a pump other than the volume pump such as an impeller pump.

Figure 18:
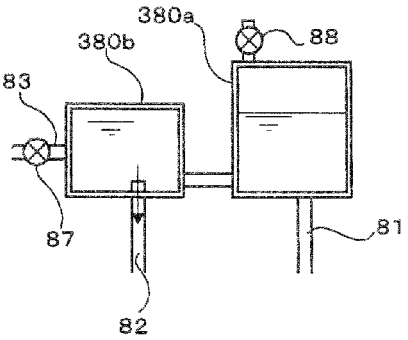
FIG. 18 is a view for explaining another modification.

Further, in the above-described embodiments, each sub-tank 80 has a box shape but as shown in FIG. 18, may be provided by an air-tight tank 380*b* and at least one tank 380*a* connected thereto (noted that those tanks may have any shape), the air communicating valve 88 being provided on the tank 380*a*. That is, an entirety of the plurality of the tanks are included in a concept of the single sub-tank.

Further, in the above-described embodiments, each actuator unit 21 is provided by the unimorph piezoelectric actuator, but the actuator unit may be constituted by bimorph piezoelectric actuators. Further, the present invention may be applied to a thermal liquid ejection apparatus including heating elements.

Further, in the above-described embodiments, the head controller 43 supplies the ejection driving signals to the actuator units 21 during only the ejection driving period extending for the predetermined length of time from the start of the purging period. However, the ejection driving period may be started after the start of the purging period and/or may be ended with the purging period. Further, the ejection driving period may coincide with the purging period.

Further, in the above-described embodiments, the head controller 43 supplies the ejection driving signals to the actuator units 21 during the ejection driving period but may supply the ink vibration signals or may supply both of the ejection driving signals and the ink vibration signals.

Further, in the above-described embodiments, the head controller 43 successively supplies the ejection driving signals for ejecting the small ink droplets, to the actuator units 21 during the ejection driving period but may supply ejection driving signals for ejecting medium-size ink droplets or large ink droplets or may supply any of the ejection driving signals once.

Further, the head controller 43 supplies no drive signals to the actuator units 21 during the circulation period before the purging period in the above-described embodiments, but may supply the drive signals to the actuator units 21 during the circulation period before the purging period. Further, the head controller 43 may supply the drive signals to the actuator units 21 immediately before or at the same time as the start of the purging period. In these cases, it is possible to vibrate the ink in the individual ink channels 132 during the circulation period, thereby peeling the air bubbles and the foreign matters adhering to the wall faces of the individual ink channels 132.

In addition, in the above-described embodiments, the head controller 43 supplies the ink vibration signals to the actuator units 21 at the same time as the end of the purging period but may supply the ink vibration signals after the end of the purging period or may not supply the ink vibration signals.

Further, in the above-described embodiments, each of the actuator units 21 functions as the actuator for generating the ejection energy for ejecting the ink droplets from the ejection openings 108 and as the actuator for applying the pressure vibrations to the ink in the individual ink channels 132, but another actuator may be provided for applying the pressure vibrations in addition to the actuator units 21.

Further, in the above-described embodiments, each actuator unit 21 is the piezoelectric actuator but may be provided by an actuator of another type such as a thermal actuator.

Figure 20:
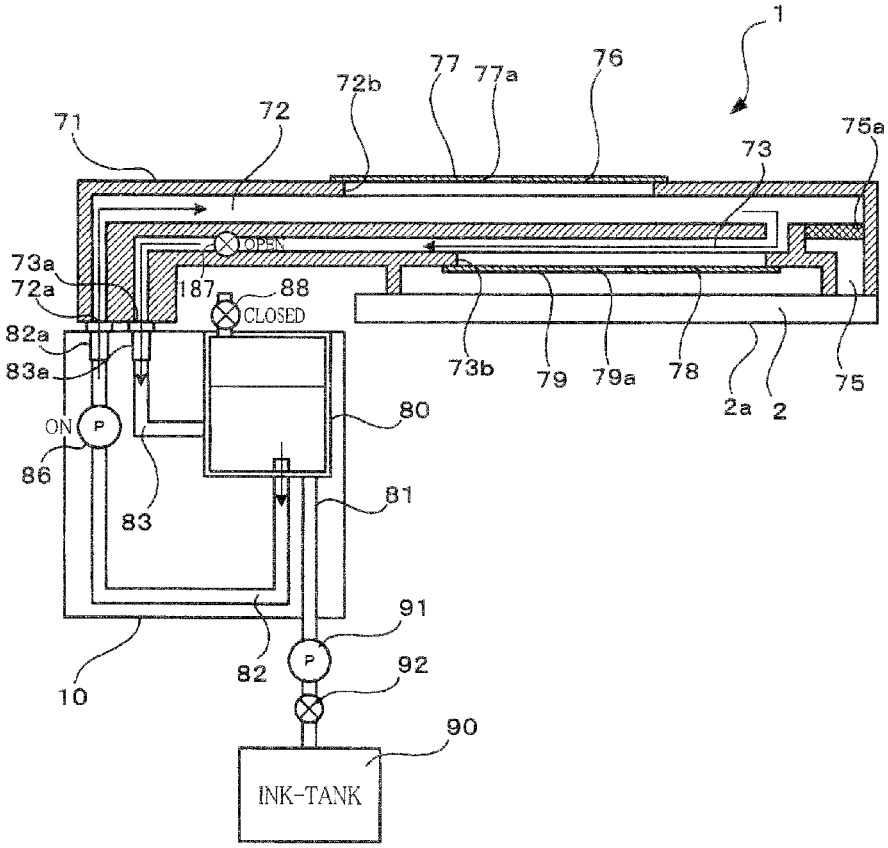
FIG. 20 is a view for explaining another modification.

Further, in the above-described embodiments, the circulation valve 87 is provided on the ink returning tube 83, but as shown in FIG. 20, a circulation valve 187 may be provided on the discharge channel 73 at a position in a predetermined area from the outlet opening 73*a* to adjust the channel resistance value of the discharge channel 73. Where the printer is configured in this manner, the circulation valve 187 is positioned near the ejection openings 108, making it possible to quickly start discharging the ink from the ejection openings 108 in the purging operation. It is noted that the term "in the predetermined area from the outlet opening 73*a*" means an area from the outlet opening 73*a* to a position at which the discharge channel 73 is branched from the ink inlet channel 72 (i.e., in the discharge channel 73).

The present invention is applicable to a liquid ejection apparatus configured to eject liquid other than the ink. Further, the present invention is applicable to a facsimile machine, a copying machine, and the like, in addition to the printer.

What is claimed is:

1. A liquid ejection apparatus comprising:

a liquid ejection head including:

an inlet opening into which liquid flows;

an outlet opening from which the liquid having flowed into the inlet opening flows;

an inside channel communicating the inlet opening and the outlet opening with each other; and a plurality of ejection openings through which is ejected the liquid having flowed through a plurality of individual channels that are branched from the inside channel;

a tank storing the liquid to be supplied to the liquid ejection head;

an air communication device configured to communicate an inside of the tank with an ambient air or interrupt the communication of the inside of the tank with the ambient air;

a supply channel communicating the inside of the tank and the inlet opening with each other;

a return channel communicating the inside of the tank and the outlet opening with each other;

a supply device configured to supply the liquid in the tank to the inside channel via the supply channel;

an adjusting device configured to adjust a channel resistance value of the return channel between a predetermined minimum value and a predetermined maximum value; and a controller configured to control the air communication device, the supply device, and the adjusting device, wherein the controller is configured to perform a liquid circulation control for circulating the liquid through the supply channel, the inside channel, and the return channel in order by controlling (i) the adjusting device such that the channel resistance value is less than the predetermined maximum value and (ii) the supply device to supply the liquid into the inside channel, wherein the controller is configured to control the adjusting device to increase the channel resistance value of the return channel in a state in which the liquid is being circulated by the liquid circulation control in which the liquid is circulated by the supply device through the supply channel, the inlet opening, the inside channel, the outlet opening and the return channel in order, to terminate the liquid circulation control and to start a liquid discharge control for discharging the liquid from the plurality of the ejection openings, wherein the controller is configured to control the air communication device such that the inside of the tank is interrupted from the ambient air in at least a part of a period of the liquid circulation control, wherein the controller is configured to control the supply device such that, when the inside of the tank is communicated with the ambient air by the air communication device in the liquid circulation control, an amount of the liquid supplied to the supply channel by the supply device per unit time is equal to or less than a first predetermined amount and such that, when the inside of the tank is interrupted from the ambient air by the air communication device, the amount of the liquid supplied to the supply channel per unit time is larger than the first predetermined amount and equal to or less than a second predetermined amount, wherein the first predetermined amount is a maximum amount in which the liquid does not leak from the plurality of the ejection openings when the inside of the tank is communicated with the ambient air by the air communication device in the liquid circulation control, and wherein the second predetermined amount is a maximum amount in which the liquid does not leak from the plurality of the ejection openings when the inside of the tank is interrupted from the ambient air by the air communication device in the liquid circulation control.

2. The liquid ejection apparatus according to claim 1, wherein the controller is configured to control the air communication device during an entire period of the liquid circulation control such that the inside of the tank is interrupted from the ambient air.

3. The liquid ejection apparatus according to claim 1, wherein the controller is configured to control the air communication device in at least a part of a period of the liquid discharge control such that the inside of the tank is communicated with the ambient air.

4. The liquid ejection apparatus according to claim 1, wherein the controller is configured to:

control the air communication device such that the inside of the tank is interrupted from the ambient air in the period of the liquid circulation control; and then control the air communication device such that the inside of the tank is communicated with the ambient air in a period of the liquid discharge control.

5. The liquid ejection apparatus according to claim 1, wherein, when the liquid is discharged by the liquid discharge control, the controller starts a liquid-discharge stopping control for stopping the discharge of the liquid from the plurality of the ejection openings, by decreasing the channel resistance value to a value less than the channel resistance value in the liquid discharge control.

6. The liquid ejection apparatus according to claim 3, wherein, when the liquid is discharged by the liquid discharge control, the controller controls:

the adjusting device to stop the discharge of the liquid from the plurality of the ejection openings by decreasing the channel resistance value to a value less than the channel resistance value in the liquid discharge control; and the air communication device such that the inside of the tank is interrupted from the ambient air.

7. The liquid ejection apparatus according to claim 6, wherein, after controlling the adjusting device to stop the discharge of the liquid from the plurality of the ejection openings, the controller controls the air communication device such that the inside of the tank is communicated with the ambient air immediately before or at the same time as a stop of the supply of the liquid by the supply device.

8. The liquid ejection apparatus according to claim 5, wherein the predetermined maximum value is a value in which the liquid is inhibited from passing through the return channel, and wherein, after the supply device has stopped supplying the liquid, the controller controls the adjusting device such that the channel resistance value becomes the predetermined maximum value.

9. The liquid ejection apparatus according to claim 1, wherein the liquid ejection head has an ejection face having the plurality of the ejection openings formed therein, and wherein the liquid ejection apparatus further comprises a wiping device configured to wipe the ejection face when the discharge of the liquid from the plurality of the ejection openings is stopped.

10. The liquid ejection apparatus according to claim 1, wherein at least a part of inner wall faces of the inside channel and the supply channel is formed of a flexible material.

11. A liquid ejection apparatus comprising:

a liquid ejection head including:

an inlet opening into which liquid flows;

an outlet opening from which the liquid having flowed into the inlet opening flows:

an inside channel communicating the inlet opening and the outlet opening with each other; and a plurality of ejection openings through which is ejected the liquid having flowed through a plurality of individual channels that are branched from the inside channel;

a tank storing the liquid to be supplied to the liquid ejection head;

an air communication device configured to communicate an inside of the tank with an ambient air or interrupt the communication of the inside of the tank with the ambient air;

a supply channel communicating the inside of the tank and the inlet opening with each other;

a return channel communicating the inside of the tank and the outlet opening with each other;

a supply device configured to supply the liquid in the tank to the inside channel via the supply channel;

an adjusting device configured to adjust a channel resistance value of the return channel between a predetermined minimum value and a predetermined maximum value; and a controller configured to control the air communication device, the supply device, and the adjusting device, wherein the controller is configured to perform a liquid circulation control for circulating the liquid through the supply channel, the inside channel, and the return channel in order by controlling (i) the adjusting device such that the channel resistance value is less than the predetermined maximum value and (ii) the supply device to supply the liquid into the inside channel, wherein the controller is configured to control the adjusting device to increase the channel resistance value of the return channel in a state in which the liquid is being circulated by the liquid circulation control in which the liquid is circulated by the supply device through the supply channel, the inlet opening, the inside channel, the outlet opening and the return channel in order, to terminate the liquid circulation control and to start a liquid discharge control for discharging the liquid from the plurality of the ejection openings, and wherein the controller is configured to control the air communication device such that the inside of the tank is interrupted from the ambient air in at least a part of a period of the liquid circulation control, wherein the liquid ejection apparatus further comprises:

a negative-pressure producing device configured to produce a pressure that is lower than an atmospheric pressure; and a negative-pressure communicating device configured to communicate or interrupt the tank with or from the negative-pressure producing device, wherein the controller is configured to control the negative-pressure communicating device to communicate the tank with the negative-pressure producing device when the inside of the tank is interrupted from the ambient air by the air communication device.

12. A liquid ejection apparatus comprising:

a liquid ejection head including:

an inlet opening into which liquid flows;

an outlet opening from which the liquid having flowed into the inlet opening flows:

an inside channel communicating the inlet opening and the outlet opening with each other; and a plurality of ejection openings through which is ejected the liquid having flowed through a plurality of individual channels that are branched from the inside channel;

a tank storing the liquid to be supplied to the liquid ejection head;

an air communication device configured to communicate an inside of the tank with an ambient air or interrupt the communication of the inside of the tank with the ambient air;

a supply channel communicating the inside of the tank and the inlet opening with each other;

a return channel communicating the inside of the tank and the outlet opening with each other;

a supply device configured to supply the liquid in the tank to the inside channel via the supply channel;

an adjusting device configured to adjust a channel resistance value of the return channel between a predetermined minimum value and a predetermined maximum value; and a controller configured to control the air communication device, the supply device, and the adjusting device, wherein the controller is configured to perform a liquid circulation control for circulating the liquid through the supply channel, the inside channel, and the return channel in order by controlling (i) the adjusting device such that the channel resistance value is less than the predetermined maximum value and (ii) the supply device to supply the liquid into the inside channel, wherein the controller is configured to control the adjusting device to increase the channel resistance value of the return channel in a state in which the liquid is being circulated by the liquid circulation control in which the liquid is circulated by the supply device through the supply channel, the inlet opening, the inside channel, the outlet opening and the return channel in order, to terminate the liquid circulation control and to start a liquid discharge control for discharging the liquid from the plurality of the ejection openings, wherein the controller is configured to control the air communication device such that the inside of the tank is interrupted from the ambient air in at least a part of a period of the liquid circulation control, wherein the liquid ejection apparatus further comprises a pressure-vibration applying device configured to apply a pressure vibration to the liquid in the individual channels, wherein, when the liquid is discharged by the liquid discharge control, the controller starts a liquid-discharge stopping control for stopping the discharge of the liquid from the plurality of the ejection openings, by decreasing the channel resistance value to a value less than the channel resistance value in the liquid discharge control, and wherein, in at least a part of a period of the liquid discharge control, the controller controls the pressure-vibration applying device to apply the pressure vibration to the liquid in the individual channels.

13. The liquid ejection apparatus according to claim 12, wherein the controller is configured to control the pressure-vibration applying device to start to apply the pressure vibration immediately before or at the same time as the start of the liquid discharge control.

14. The liquid ejection apparatus according to claim 13, wherein the controller is configured to control the pressure-vibration applying device such that the application of the pressure vibration is continued for at least a predetermined length of time from a start of the application of the pressure vibration and such that the continuation of the application of the pressure vibration is stopped before the discharge of the liquid is stopped.

15. The liquid ejection apparatus according to claim 12, wherein the controller is configured to control the pressure-vibration applying device during the liquid discharge control such that the pressure vibration applied to the liquid in the plurality of the individual channels by the pressure-vibration applying device is a pressure vibration by a pressure for ejecting the liquid from the plurality of the ejection openings.

16. The liquid ejection apparatus according to claim 12, wherein the controller is configured to control the pressure-vibration applying device after a start of the liquid-discharge stopping control, such that the pressure vibration is applied without the ejection of the liquid from the plurality of the ejection openings.

17. The liquid ejection apparatus according to claim 12, wherein the pressure-vibration applying device is a piezoelectric actuator configured to apply a pressure for ejecting the liquid from the plurality of the ejection openings, to the liquid in the plurality of individual channels.

* * * * *